US011139127B2

(12) United States Patent
Watanabe

(10) Patent No.: US 11,139,127 B2
(45) Date of Patent: Oct. 5, 2021

(54) SWITCH DEVICE

(71) Applicant: ALPS ALPINE CO., LTD., Tokyo (JP)

(72) Inventor: Yoshiyuki Watanabe, Miyagi (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 16/907,751

(22) Filed: Jun. 22, 2020

(65) Prior Publication Data

US 2020/0321170 A1 Oct. 8, 2020

Related U.S. Application Data

(63) Continuation of application No. PCT/JP2018/038273, filed on Oct. 15, 2018.

(30) Foreign Application Priority Data

Dec. 25, 2017 (JP) ..... JP2017-247928

(51) Int. Cl.
*H01H 13/14* (2006.01)
*H01H 13/66* (2006.01)
(Continued)

(52) U.S. Cl.
CPC ..... *H01H 13/66* (2013.01); *H01H 13/14* (2013.01); *H01H 23/16* (2013.01); *H01H 23/24* (2013.01)

(58) Field of Classification Search
CPC ..... H01H 13/66; H01H 23/16; H01H 23/24; H01H 13/14; H01H 13/64; H01H 13/48; H01H 13/52; H01H 13/26; H01H 13/20; H01H 23/003; H01H 2300/01; H01H 13/705; H01H 2221/016; H01H 2225/018; H01H 2231/026; H01H 2237/006; H01H 19/635; H01H 2021/225; H01H 21/22;
(Continued)

(56) References Cited

U.S. PATENT DOCUMENTS

2011/0042189 A1 2/2011 Konno et al.

FOREIGN PATENT DOCUMENTS

JP 2542424 10/1996
JP 2000-011807 1/2000
(Continued)

OTHER PUBLICATIONS

International Search Report for PCT/JP2018/038273 dated Dec. 11, 2018.

*Primary Examiner* — Ahmed M Saeed
(74) *Attorney, Agent, or Firm* — IPUSA, PLLC

(57) ABSTRACT

A switch device includes a first rubber dome, a second rubber dome, and a slider disposed on the first rubber dome and the second rubber dome. The slider presses the upper surface of the first rubber dome, causing deformation of the first rubber dome when the slider is moved toward the first and second rubber domes, and presses the upper surface of the second rubber dome, causing deformation of the second rubber dome when the slider is further moved toward the first and second rubber domes in a state in which the first rubber dome is subjected to the deformation. A thick portion is formed on each side of the second rubber dome so as to increase the thickness on the each side of the second rubber dome. Each side of the second rubber dome is in a direction in which the first and second rubber domes are aligned.

6 Claims, 24 Drawing Sheets

(51) Int. Cl.
*H01H 23/16* (2006.01)
*H01H 23/24* (2006.01)

(58) Field of Classification Search
CPC ..... H01H 21/50; H01H 2221/018; H01H 2239/058; H01H 23/143; H01H 23/162; H01H 23/205; H01H 25/008; H01H 9/181
See application file for complete search history.

(56) References Cited

FOREIGN PATENT DOCUMENTS

| | | |
|---|---|---|
| JP | 2011-044304 | 3/2011 |
| JP | 2016-001557 | 1/2016 |

SWITCH DEVICE

CROSS-REFERENCE TO RELATED APPLICATIONS

This application is a continuation of International Application No. PCT/JP2018/038273, filed on Oct. 15, 2018 and designating the U.S., which claims priority to Japanese Patent Application No. 2017-247928, filed on Dec. 25, 2017. The contents of these applications are incorporated herein by reference in their entirety.

BACKGROUND OF THE INVENTION

1. Field of the Invention

The disclosures herein generally relate to a switch device.

2. Description of the Related Art

As a switch device, a two-stage switch that includes two switches is known. In the two-stage switch, when a pressing member is pressed, one switch is turned on first, and the other switch is turned on next, thereby enabling a two-stage on/off operation. Such a two-stage switch is used in a variety of applications, including a switch for operation of power windows.

Two switches included in such a two-stage switch each include two fixed contacts provided on the surface of a substrate, and also a rubber dome that covers the two fixed contacts. Further, a movable contact is provided within the rubber dome. In each of the switches, when a pressing member is pressed, the rubber dome deforms toward the substrate, and the movable contact provided within the rubber dome contacts the both fixed contacts provided on the surface of the substrate. In this manner, each of the switches is closed and is turned on. In the two-stage switch as described above, the two switches can be turned on at different timings by providing an actuator between the pressing member and the two rubber domes. That is, after one of the switches is turned on, the pressing member is further pressed, thereby allowing the other switch to be turned on.

When such a two-stage switch is used for operation of power windows of an automotive vehicle, one switch can be used in manual mode and the other switch can be used in auto mode. When the one switch in manual mode is turned on, a side window is moved up and down only when the switch is being turned on. Subsequently, when the other switch in auto mode is turned on, the side window continues opening or closing even after the switch is released.

It is desirable for such a two-stage switch to have improved longevity and provide improved tactile feel for two-stage operation.

RELATED-ART DOCUMENTS

Patent Documents

[Patent Document 1] Japanese Laid-Open Patent Publication No. 2-40820

[Patent Document 2] Japanese Laid-Open Patent Publication No. 2016-1557

SUMMARY OF THE INVENTION

It is a general object of the described embodiments to provide a two-stage switch that provides improved tactile feel for two-stage operation and has improved longevity.

According to one embodiment, a switch device includes a first rubber dome having a first upper surface; a second rubber dome having a second upper surface and having each side; and a slider disposed on the first upper surface of the first rubber dome and the second upper surface of the second rubber dome. The slider presses the first upper surface of the first rubber dome, causing deformation of the first rubber dome in a case where the slider is moved toward the first rubber dome and the second rubber dome, and the slider presses the second upper surface of the second rubber dome, causing deformation of the second rubber dome in a case where the slider is further moved toward the first rubber dome and the second rubber dome in a state in which the first rubber dome is subjected to the deformation. A thick portion is formed on the each side of the second rubber dome so as to increase a thickness on each side of the second rubber dome. Each side of the second rubber dome is in a direction in which the first rubber dome and the second rubber dome are aligned.

BRIEF DESCRIPTION OF THE DRAWINGS

Other objects and further features of the present invention will be apparent from the following detailed description when read in conjunction with the accompanying drawings, in which.

DESCRIPTION OF THE EMBODIMENTS

Figure 1:
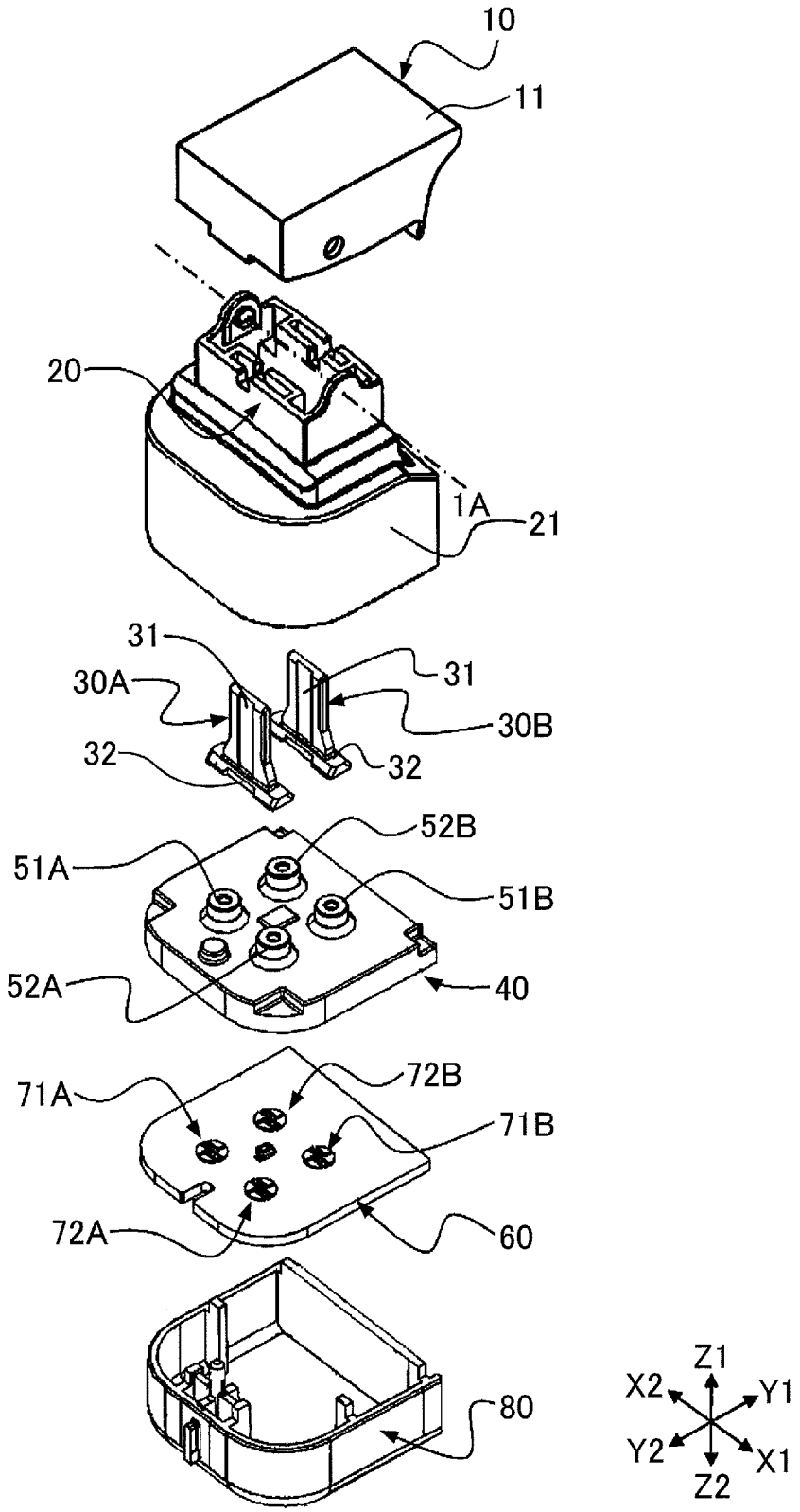
FIG. 1 is an exploded perspective view of a switch device according to an embodiment.

According to the disclosure herein, a two-stage switch providing improved tactile feel for two-stage operation and with improved longevity is described.

In the following, embodiments will be described. The same members are denoted by the same reference numerals, and a description thereof will not be repeated. Further, in the present application, an X1-X2 direction, a Y1-Y2 direction, and a Z1-Z2 direction are mutually perpendicular directions. Further, a plane including the X1-X2 direction and the Y1-Y2 direction is referred to as a XY-plane, a plane including the Y1-Y2 direction and the Z1-Z2 direction is referred to as a YZ-plane, and a plane including the Z1-Z2 direction and the X1-X2 direction is referred to as a ZX-plane.

(Two-Stage Switch)

Figure 2:
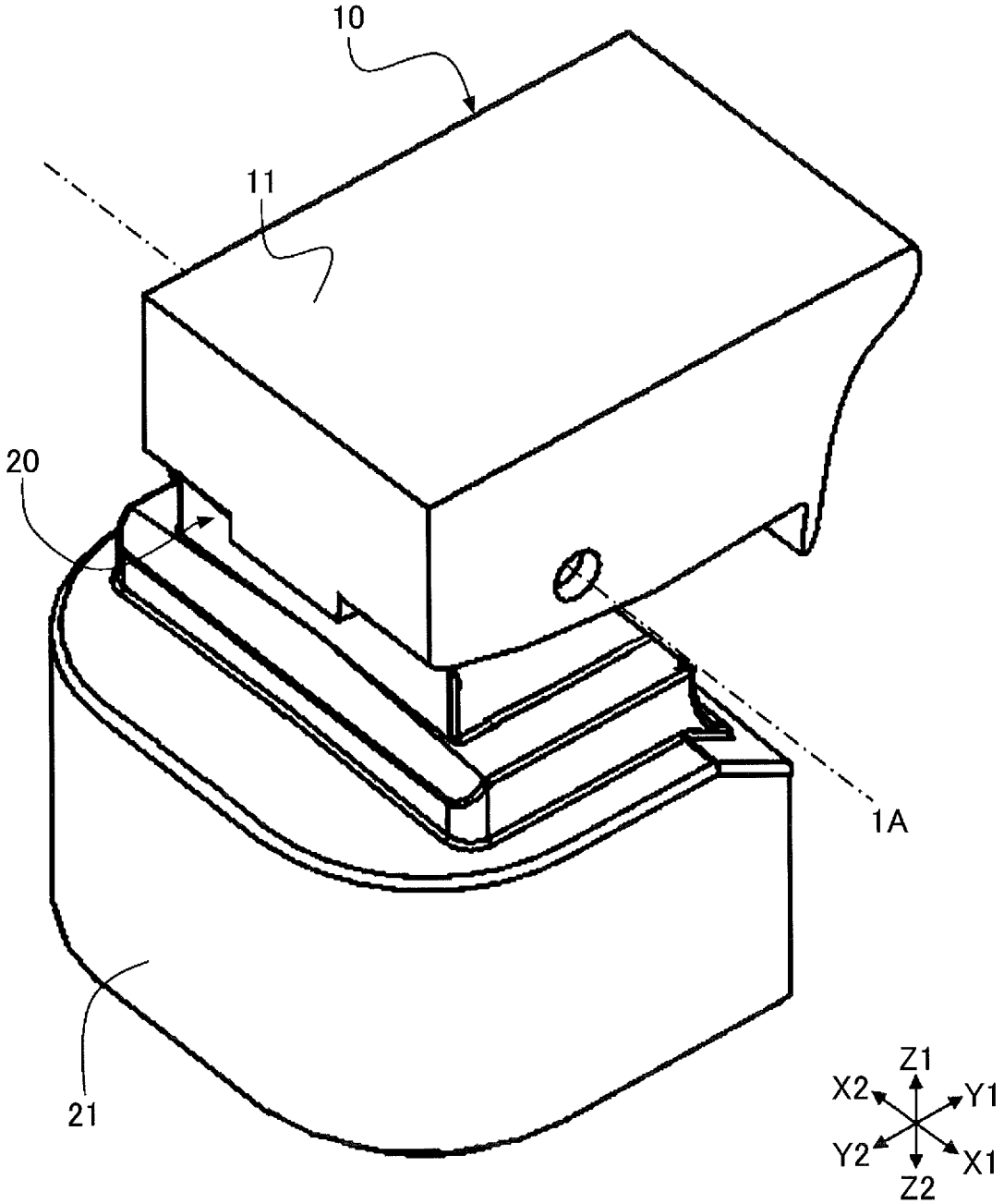
FIG. 2 is a perspective view of the switch device according to the embodiment.
Figure 3A:
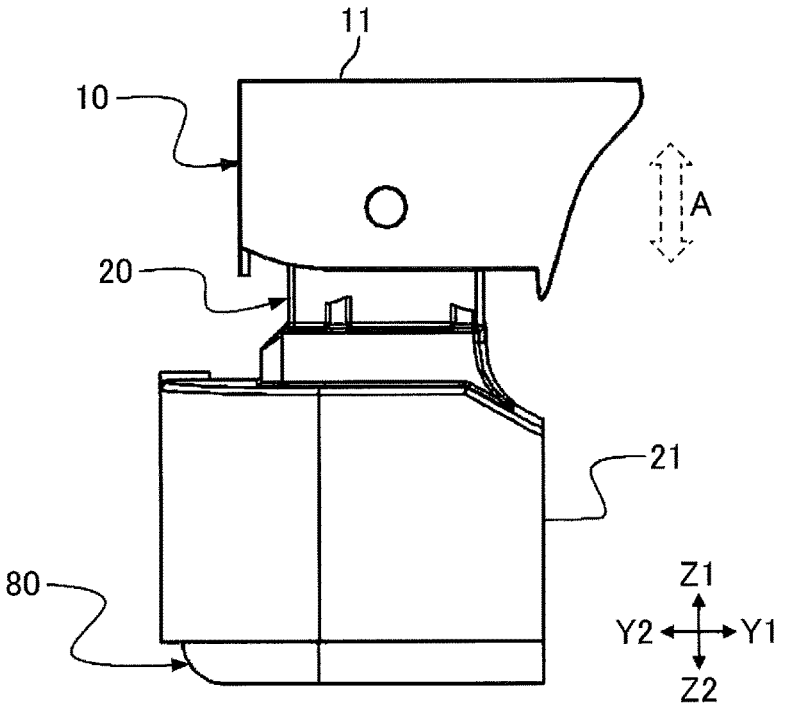
FIG. 3A is a side view of the switch device according to the embodiment.
Figure 3B:
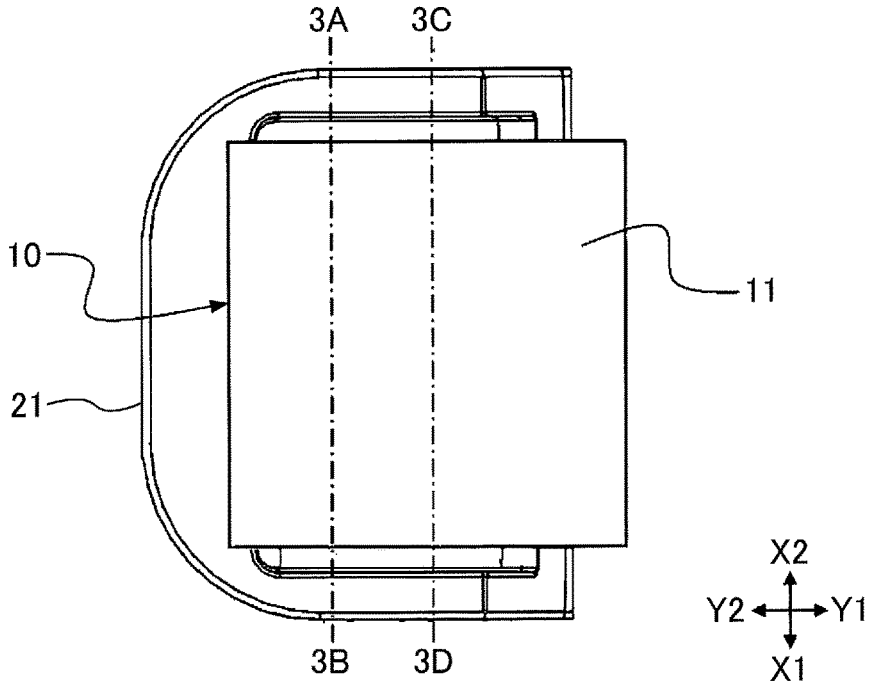
FIG. 3B is a top view of the switch device according to the embodiment.
Figure 4:
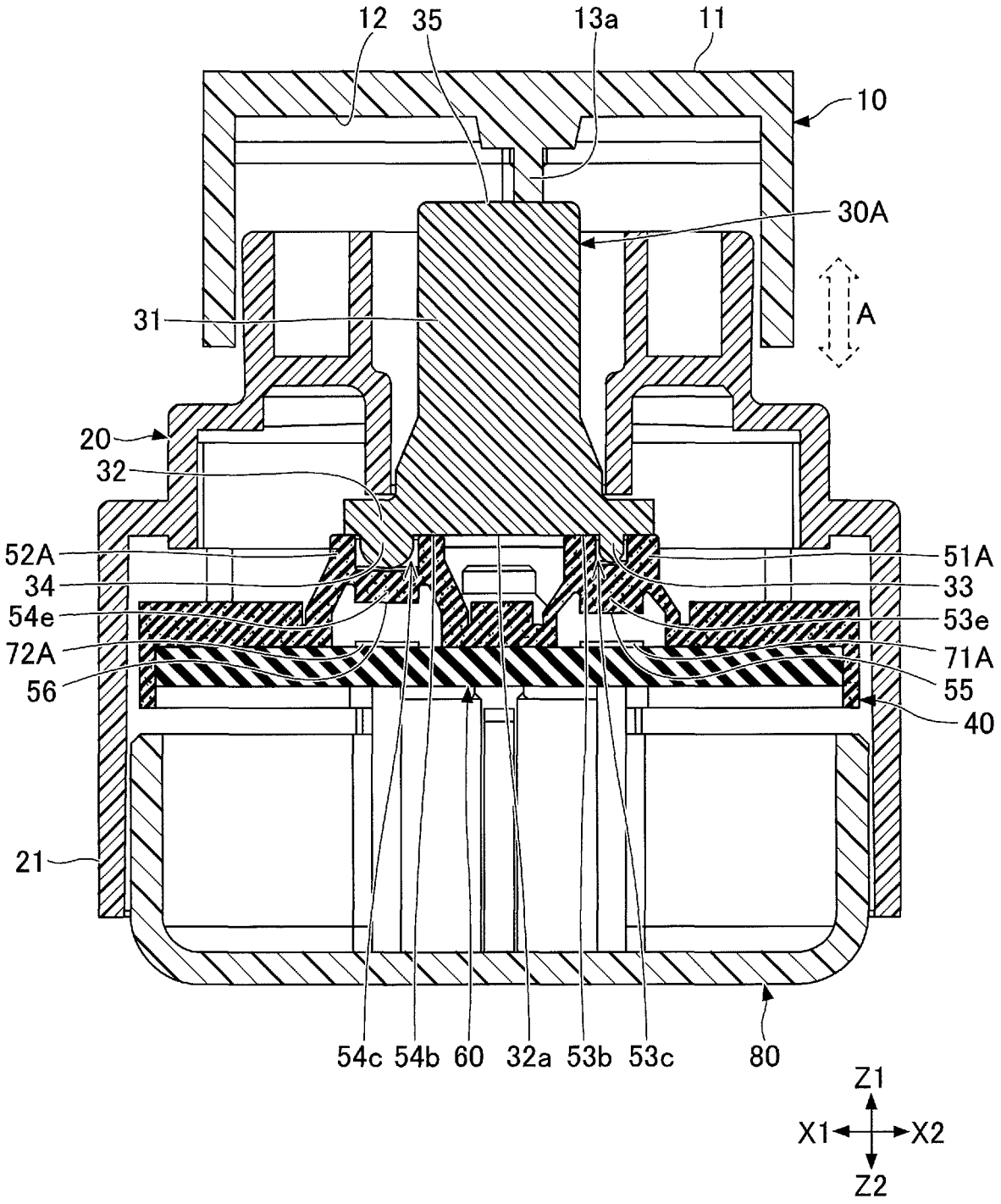
FIG. 4 is a cross-sectional view (1) of the switch device according to the embodiment.
Figure 5:
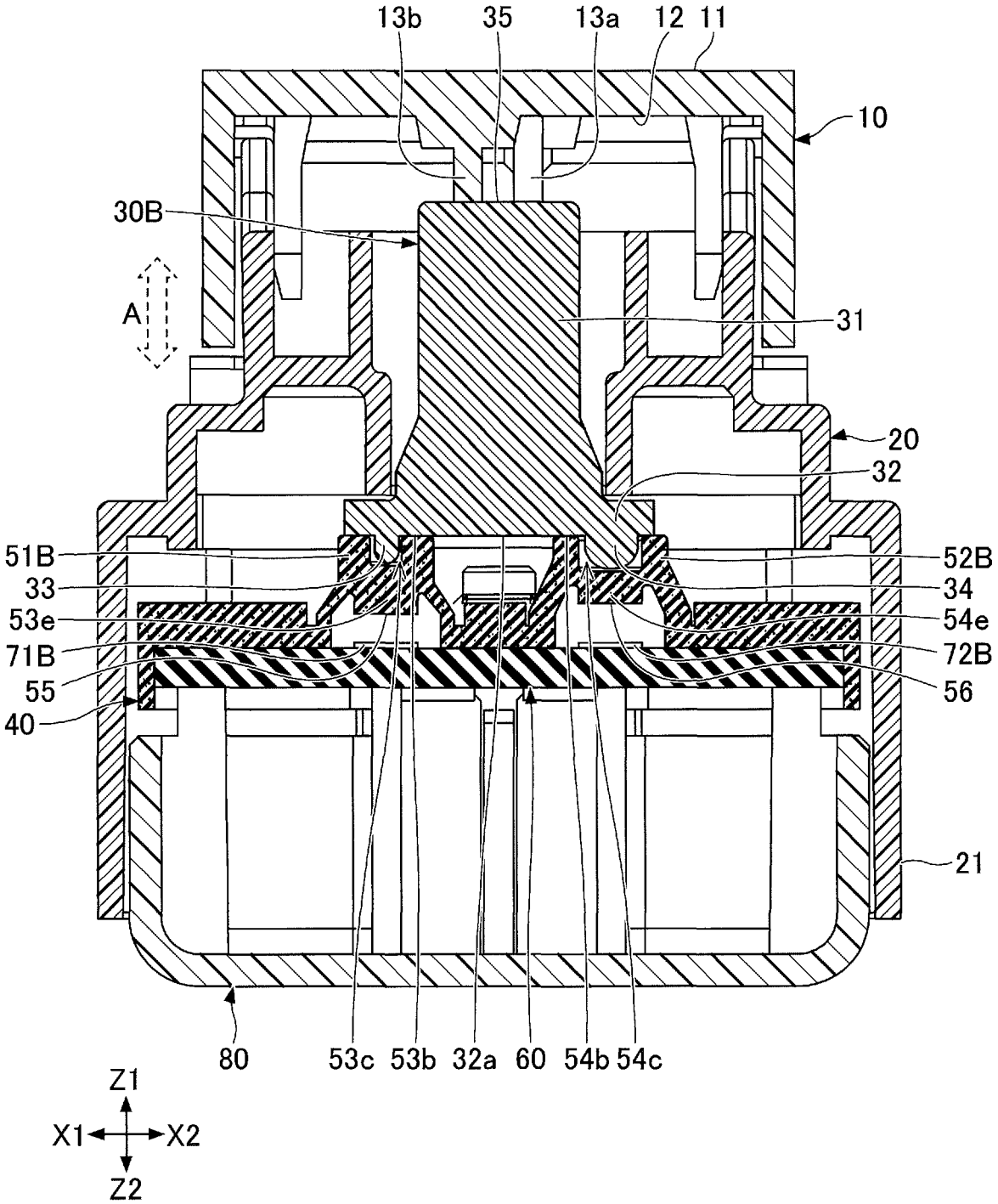
FIG. 5 is a cross-sectional view (2) of the switch device according to the embodiment.

A switch device including a two-stage switch according to an embodiment will be described. FIG. 1 is an exploded perspective view of the switch device according to the embodiment. FIG. 2 is a perspective view of the switch device according to the embodiment. FIG. 3A is a side view of the switch device according to the embodiment. FIG. 3B is a top view of the switch device according to the embodiment. FIG. 4 is a cross-sectional view of the switch device taken through dash-dot line 3A-3B of FIG. 3B. FIG. 5 is a cross-sectional view of the switch device taken through dash-dot line 3C-3D of FIG. 3B.

The switch device according to the embodiment includes an operation part 10, a support part 20, two actuators 30A and 30B (examples of a slider), a rubber dome sheet 40, a substrate 60, and a lower case 80.

The operation part 10 is a part that is touched by an operator of the switch device according to the embodiment for operation. The operation part 10 is formed by injection molding of a heat-resistant synthetic resin such as an acrylonitrile butadiene styrene (ABS) copolymer resin. The operation part 10 has a box shape, and the upper surface of the operation part 10 is referred to as an operation surface 11 and is pressed by the operator for operation.

The operation part 10 is attached to the support part 20 so as to move about the axis indicated by dotted line 1A in FIG. 2. When the operation surface 11 of the operation part 10 is pressed from the top, namely pressed from the Z1 side toward the Z2 side, the operation part 10 moves in the Z2 direction. Therefore, the operation part 10 can be moved up and down as indicated by dashed arrow A of FIG. 3A.

As illustrated in FIG. 4 and FIG. 5, two protrusions 13*a* and 13*b* are formed within the operation part 10. The protrusions 13*a* and 13*b* extend in the Z2 direction from a ceiling 12 located on the side of the operation part 10 opposite to the operation surface 11. The protrusion 13*a* of the two protrusions is located at a position corresponding to the actuator 30A, and the other protrusion 13*b* is located at a position corresponding to the actuator 30B.

The support part 20 is formed by injection molding of a synthetic resin, such as a heat-resistant ABS resin. The Z1 side of the support part 20, which is the upper side, supports the operation part 10, and the Z2 side of the support part 20, which is the lower side, serves as an upper case 21. Projections are formed on the upper side of the support part 20. The projections of the support part 20 extend in the Z1 direction and face the inner side surfaces of the operation part 10. Further, the projections of the support part 20 are inserted into engagement portions of the operation part 10, so as to movably support the operation part 10.

The lower case 80 has a box shape, and is formed by injection molding of a synthetic resin, such as a heat-resistant ABS resin, similar to the support part 20 of the upper case 21. In the switch device according to the present embodiment, a box body having a space inside thereof is formed by connecting the upper case 21 of the support part 20 to the lower case 80. The actuators 30A and 30B, the rubber dome sheet 40, and the substrate 60 are housed within the box body.

The actuators 30A and 30B are formed by injection molding of a synthetic resin such as polyoxymethylene (POM). Each of the actuators 30A and 30B includes a rectangular, flat body portion 31, and also a pressing portion 32 provided on the Z2 side of the body portion 31. In each of the actuators 30A and 30B, two projections 33 and 34 are formed on respective sides in the X1-X2 direction of the bottom surface 32*a* located on the Z2 side of the pressing portion 32.

The protrusion 13*a* and the protrusion 13*b*, which respectively correspond to the actuator 30A and the actuator 30B and are formed on the ceiling 12 of the operation part 10, come into contact with respective upper surfaces 35 on the Z1 side of body portions 31 of the actuator 30A and the actuator 30B.

Specifically, as illustrated in FIG. 4, the protrusion 13*a* formed on the ceiling 12 within the operation part 10 contacts the upper surface 35 of a corresponding body portion 31 of the actuator 30A, at a position on the X2 side relative to the center of the upper surface 35 of the body portion 31.

Further, as illustrated in FIG. 5, the protrusion 13*b* formed on the ceiling 12 within the operation part 10 contacts the upper surface 35 of a corresponding body portion 31 of the actuator 30B, at a position on the X1 side relative to the center of the upper surface 35 of the body portion 31.

The actuators 30A and 30B are moved in the Z1-Z2 direction by operating the operation part 10. Specifically, the actuators 30A and 30B move in the Z2 direction by pressing the operation surface 11 of the operation part 10. In the present embodiment, the positions, where the protrusions 13*a* and 13*b* formed inside the operation part 10 contact the respective upper surfaces 35 of the actuators 30A and 30B, are shifted from the center of the upper surfaces 35. Accordingly, when the actuators 30A and 30B are pressed by the operation part 10, the actuators 30A and 30B are tilted.

Figure 6:
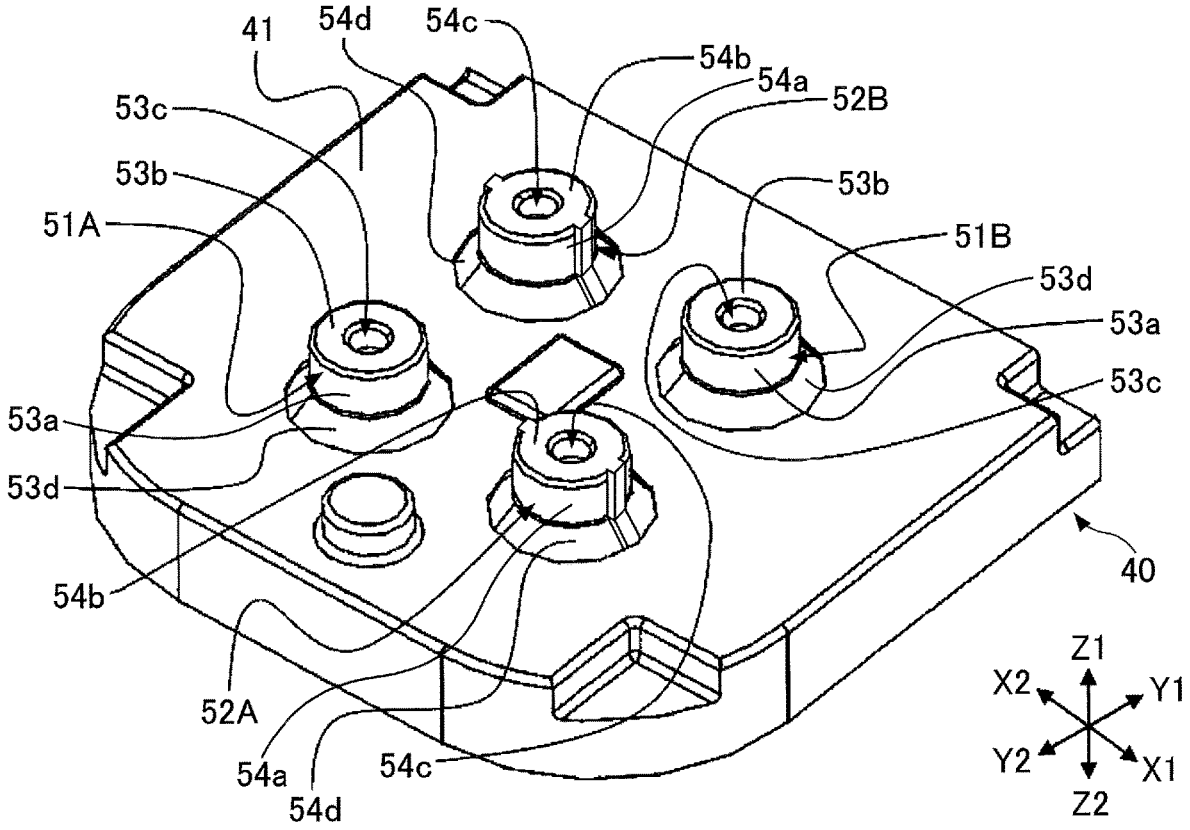
FIG. 6 is a perspective view of a rubber dome sheet of the switch device according to the embodiment.

Next, the rubber dome sheet 40 will be described with reference to FIG. 6. In the present embodiment, the rubber dome sheet 40 is formed of an elastic material such as synthetic rubber, and includes four rubber domes 51A, 52A, 51B, and 52B. The rubber domes 51A, 52A, 51B, and 52B are formed on an approximately box-shaped base 41 and protrude in the Z1 direction. In the present embodiment, the rubber domes 51A and 51B may be referred to as first rubber domes, and the rubber domes 52A and 52B may be referred to as second rubber domes.

Each of the first rubber domes 51A and 51B includes an upper portion 53*a* that projects in the Z1 direction, and a recess 53*c* that is formed at the center of the upper surface 53*b* located on the Z1 side of the upper portion 53*a*. A deformation portion 53*d* is formed between the upper portion 53*a* and the base 41. The deformation portion 53*d* buckles such that the upper portion 53*a* deforms in the Z2 direction.

Each of the second rubber domes 51A and 51B includes an upper portion 54*a* that projects in the Z1 direction, and a recess 54*c* that is formed at the center of the upper surface 54*b* located on the Z1 side of the upper portion 54*a*. A deformation portion 54*d* is formed between the upper portion 54*a* and the base 41. The deformation portion 54*d* buckles such that the upper portion 54*a* deforms in the Z2 direction.

Further, as illustrated in FIG. 4 and FIG. 5, a lower portion 53*e* that projects in the Z2 direction is formed within each of the first rubber domes 51A and 51B, and a movable contact 55 is provided on the surface on the Z2 side of the lower portion 53*e*. Similarly, a lower portion 54*e* that projects in the Z2 direction is formed within each of the second rubber domes 52A and 52B, and a movable contact 56 is provided on the surface on the Z2 side of the lower portion 54*e*.

In the present embodiment, the movable contact 55 and the movable contact 56 are formed of electrically conductive carbon or the like. Specifically, the movable contact 55 and the movable contact 56 are formed of an electrically conductive ink in which electrically conductive powder, such as carbon, is dispersed in a synthetic resin binder.

The first rubber dome 51A and the second rubber dome 52A are disposed at positions corresponding to the actuator 30A. The projection 33 formed on a corresponding pressing portion 32 of the actuator 30A is inserted into the recess 53*c* of the first rubber dome 51A, and the projection 34 is inserted into the recess 54*c* of the second rubber dome 52A. In this state, the bottom surface 32*a* of the pressing portion 32 of the actuator 30A is in contact with the upper surface 53*b* of the first rubber dome 51A and the upper surface 54*b* of the second rubber dome 52A.

The first rubber dome 51B and the second rubber dome 52B are disposed at positions corresponding to the actuator 30B. The projection 33 formed on a corresponding pressing portion 32 of the actuator 30B is inserted into the recess 53*c* of the first rubber dome 51B, and the projection 34 is inserted into the recess 54*c* of the second rubber dome 52B. In this state, the bottom surface 32*a* of the pressing portion 32 of the actuator 30B is in contact with the upper surface 53*b* of the first rubber dome 51B and the upper surface 54*b* of the second rubber dome 52B.

Figure 7:
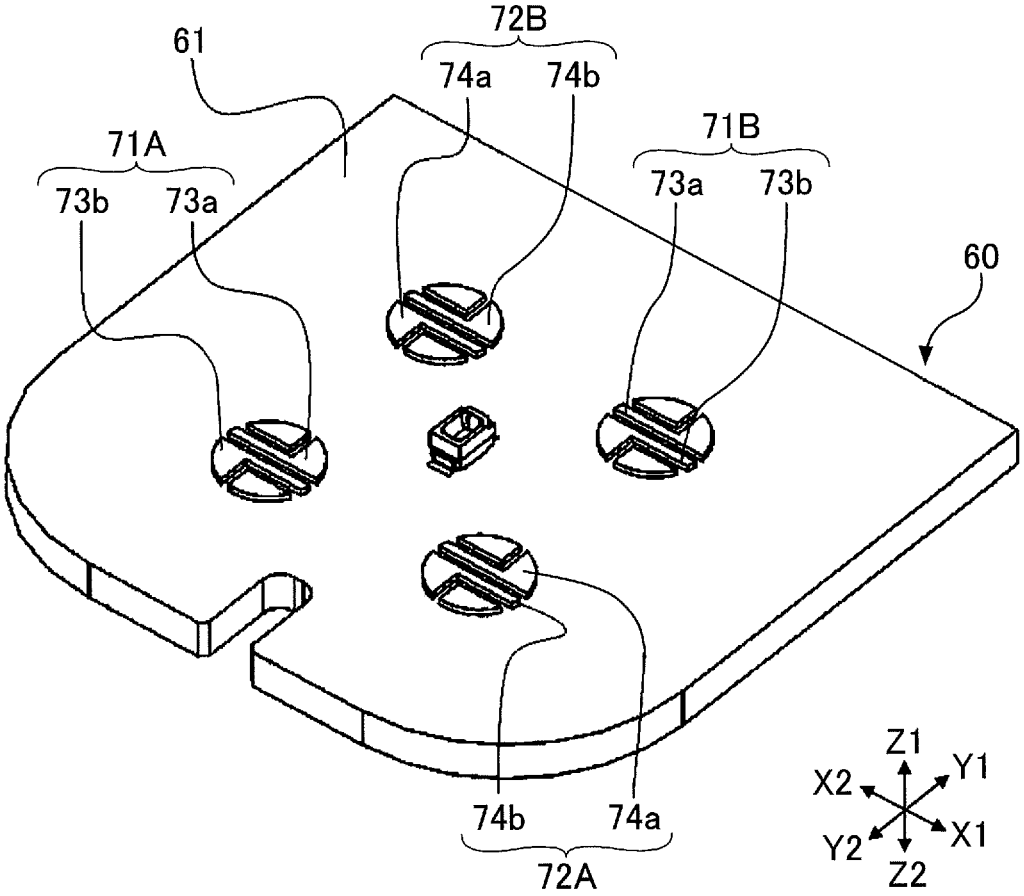
FIG. 7 is a perspective view of a substrate of the switch device according to the embodiment.

Next, the substrate 60 will be described with reference to FIG. 7. In the present embodiment, the substrate 60 is a printed circuit board (PCB) in which a metal film such as copper foil is patterned on the surface of a substrate body 61. Specifically, four fixed contacts, namely first fixed contacts 71A and 71B and second fixed contacts 72A and 72B are formed on one surface of the substrate 60. The first fixed contact 71A, the first fixed contact 71B, the second fixed contact 72A, and the second fixed contact 72B are formed at positions respectively corresponding to the four rubber domes 51A, 51B, 52A, and 52B provided on the rubber dome sheet 40.

The first fixed contacts 71A and 71B each include one fixed contact 73*a* and another fixed contact 73*b*, formed by the metal film on the surface of the substrate body 61. The second fixed contacts 72A and 72B each include one fixed contact 74*a* and another fixed contact 74, formed by the metal film on the surface of the substrate body 61.

In the switch device according to the present embodiment, the rubber dome sheet 40 is disposed at a predetermined position on the substrate 60. Therefore, the first fixed contact 71A is disposed at a position corresponding to the first rubber dome 51A of the rubber dome sheet 40, and the second fixed contact 72A is disposed at a position corresponding to the second rubber dome 52A of the rubber dome sheet 40. Similarly, the first fixed contact 71B is disposed at a position corresponding to the first rubber dome 51B of the rubber dome sheet 40, and the second fixed contact 72B is disposed at a position corresponding to the second rubber dome 52B of the rubber dome sheet 40.

With the above configuration, the movable contact 55 of the first rubber dome 51A of the rubber dome sheet 40 faces the first fixed contact 71A formed on the substrate 60. Therefore, a first switch is configured by the first fixed contact 71A and the first rubber dome 51A. In addition, the movable contact 56 of the second rubber dome 52A of the rubber dome sheet 40 faces the second fixed contact 72A formed on the substrate 60. Therefore, a second switch is configured by the second fixed contact 72A and the second rubber dome 52A. The first switch configured by the first fixed contact 71A and the first rubber dome 51A, and the second switch configured by the second fixed contact 72A and the second rubber dome 52A are operated by the actuator 30A.

Further, the movable contact 55 of the first rubber dome 51B of the rubber dome sheet 40 faces the first fixed contact 71B formed on the substrate 60. Therefore, a first switch is configured by the first fixed contact 71B and the first rubber dome 51B. In addition, the movable contact 56 of the second rubber dome 52B of the rubber dome sheet 40 faces the second fixed contact 72B formed on the substrate 60. Therefore, a second switch is configured by the second fixed contact 72B and the second rubber dome 52B. The first switch configured by the first fixed contact 71B and the first rubber dome 51B, and the second switch configured by the second fixed contact 72B and the second rubber dome 52B are operated by the actuator 30B.

In the present embodiment, the operation part 10 is moved in the Z2 direction by pressing the operation surface 11 of the Operation part 10 downward, that is, in the Z2 direction. As a result, the upper surface 35 of the actuator 30A is pressed by the protrusion 13*a* formed within the operation part 10, and the upper surface 35 of the actuator 30B is pressed by the protrusion 13*b*.

As described, the upper surface 35 of the actuator 30A is pressed by the protrusion 13*a* formed within the operation part 10, thereby causing the actuator 30A to be tilted. Then, the first rubber dome 51A, including the recess 53*c* into which the projection 33 of the pressing portion 32 of the actuator 30A is inserted, is pressed, thereby causing the deformation portion 53*d* of the first rubber dome 51A to be deformed. As a result, the movable contact 55 provided within the first rubber dome 51A contacts the fixed contact 73*a* and the fixed contact 73*b* of the first fixed contact 71A, thus causing the fixed contact 73*a* and the fixed contact 73*b* to be electrically connected and the first switch to be turned on.

In this state, by pressing the operation surface 11 of the operation part 10 downward, that is, in the Z2 direction, the actuator 30A is further moved. Then, the second rubber dome 52A, including the recess 54*c* into which the projection 33 of the pressing portion 32 of the actuator 30A is inserted, is pressed, thereby causing the deformation portion 54*d* of the second rubber dome 52A to be deformed. As a result, the movable contact 56 provided within the second rubber dome 52A contacts the fixed contact 74*a* and the fixed contact 74*b* of the second fixed contact 72A, thus causing the fixed contact 74*a* and the fixed contact 74*b* to be electrically connected and the second switch to be turned on.

Accordingly, in the switch device according to the embodiment, the first switch is first turned on by pressing the operation surface 11 of the operation part 10 downward, that is, in the Z2 direction. In this state, the second switch remains off. Then, by pressing the operation surface 11 of the operation part 10 further downward, the second switch is turned on. In this manner, both the first switch and the second switch are turned on.

(Rubber Dome)

Figure 8:
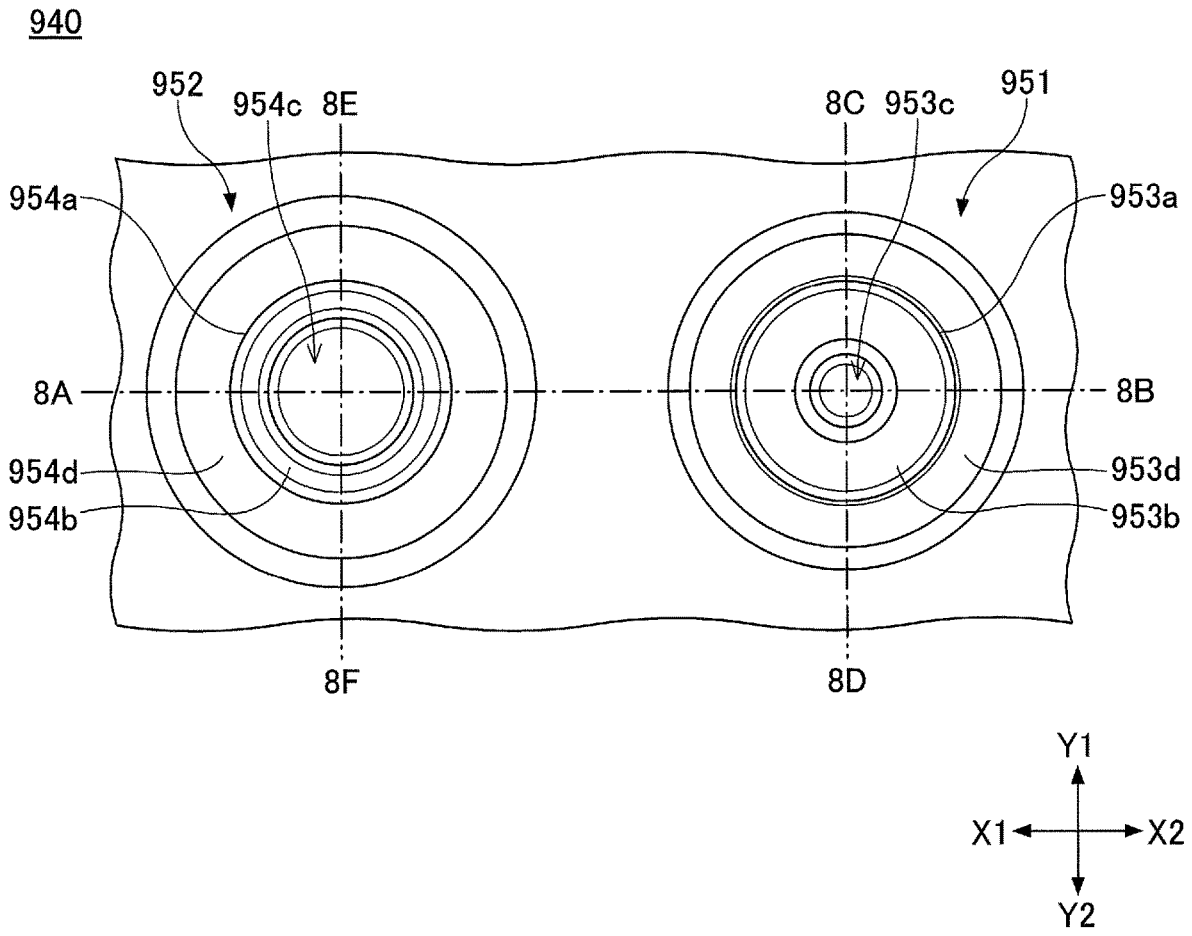
FIG.8 PRIOR ART
FIG. 8 is a top view of a rubber dome sheet.
Figure 9:
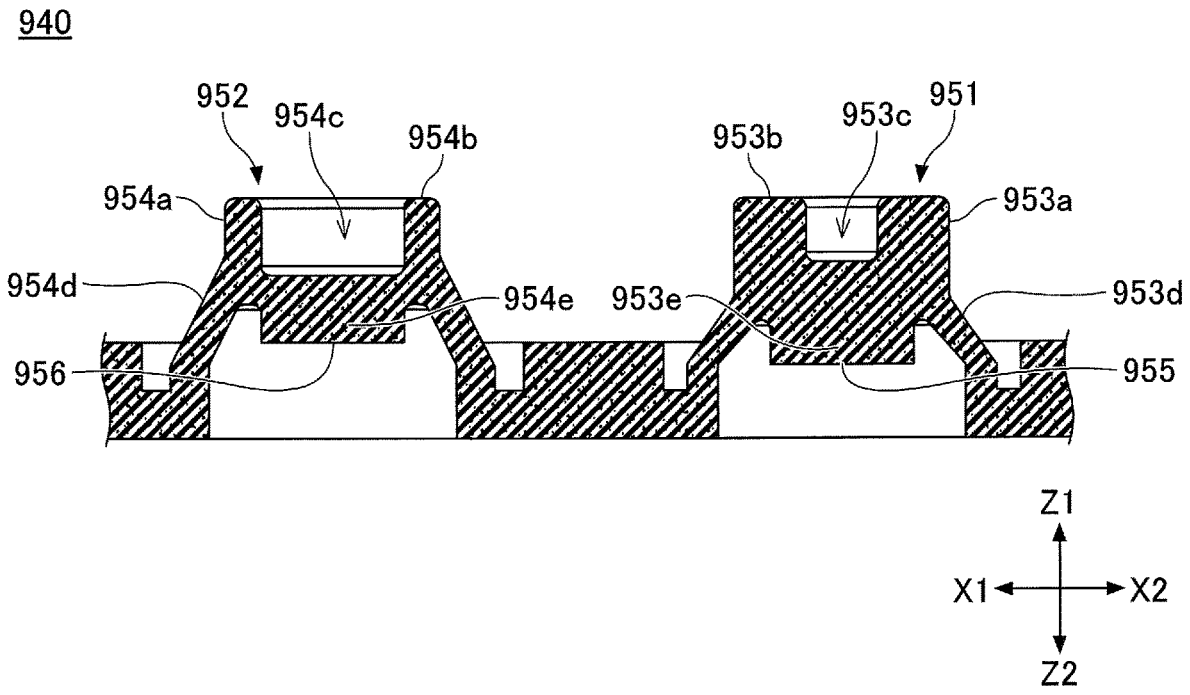
FIG.9 PRIOR ART
FIG. 9 is a cross-sectional view (1) of the rubber dome sheet.
Figure 10A:
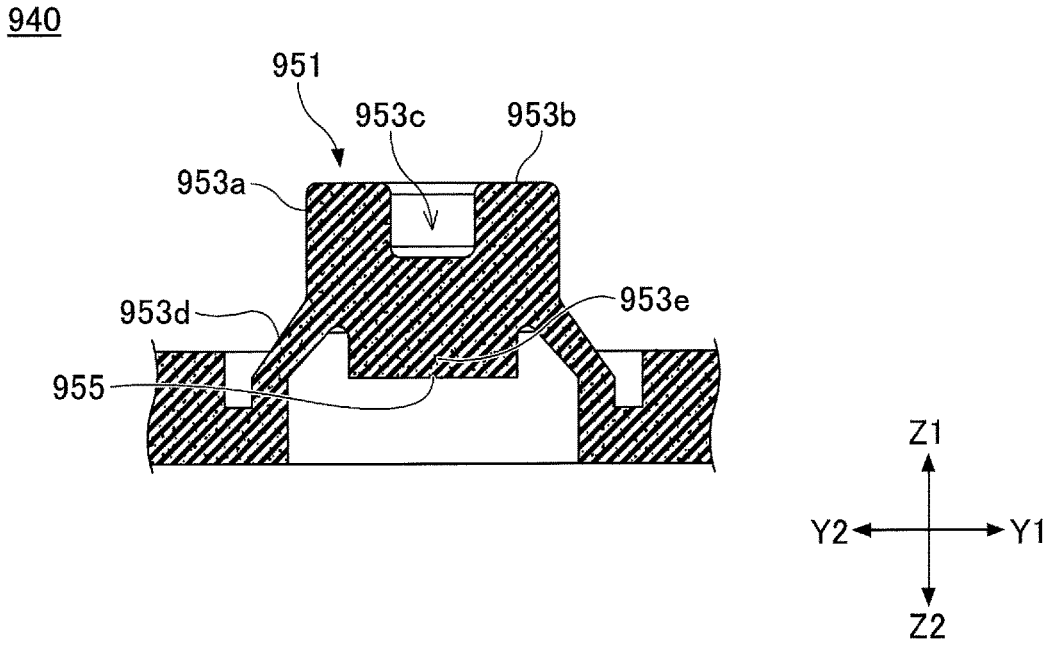
FIG.10A PRIOR ART
FIG. 10A is a cross-sectional view (2) of the rubber dome sheet.
Figure 10B:
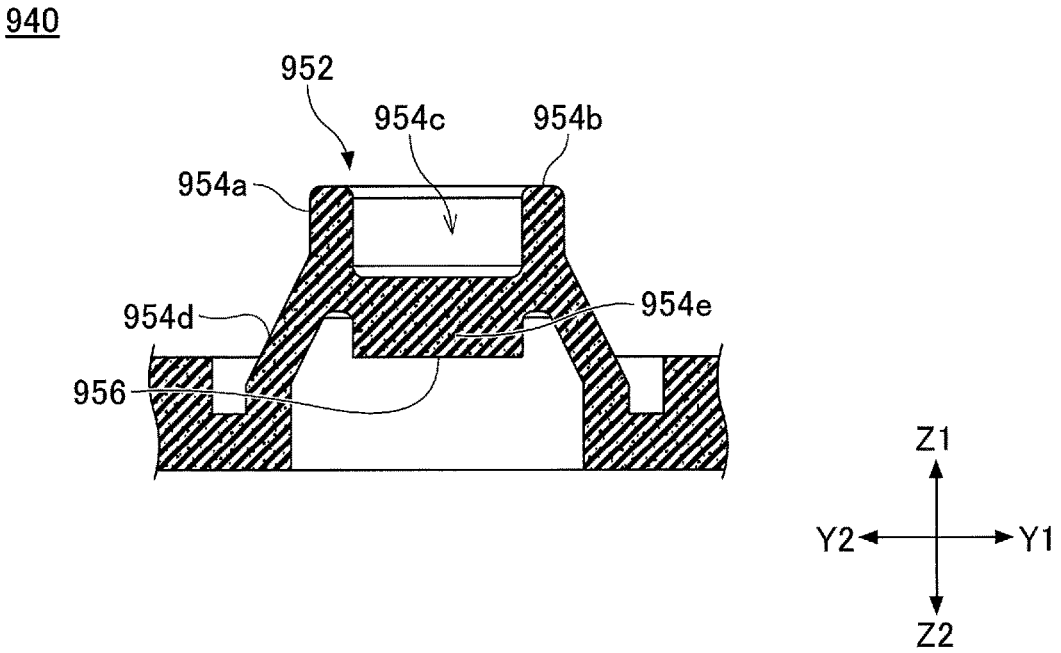
FIG.10B PRIOR ART
FIG. 10B is a cross-sectional view (3) of the rubber dome sheet.

Next, tactile feel for operation of a two-stage switch using a typical rubber dome sheet as illustrated in FIG. 8 through FIG. 10B will be described. FIG. 8 is a top view of a rubber dome sheet 940. FIG. 9 is a cross-sectional view of the rubber dome sheet 940 taken through dash-dot line 8A-8B of FIG. 8. FIG. 10A is a cross-sectional view of the rubber dome sheet 940 taken through dash-dot line 8C-8D of FIG. 8. FIG. 10B is a cross-sectional view of the rubber dome sheet 940 taken through dash-dot line 8E-8F of FIG. 8. The rubber dome sheet 940 includes a first rubber dome 951 and a second rubber dome 952.

The first rubber dome 951 includes an upper portion 953*a* that projects in the Z1 direction, and a recess 953*c* that is formed at the center of the upper surface 953*b* on the Z1 side of the upper portion 953*a*. A deformation portion 953*d* is formed between the upper portion 953*a* and a base. The deformation portion 953*d* buckles such that the upper portion 953*a* deforms in the Z2 direction.

The second rubber dome 952 includes an upper portion 954*a* that projects in the Z1 direction, and a recess 954*c* that is formed at the center of the upper surface 954*b* on the Z1 side of the upper portion 954*a*. A deformation portion 954*d* is formed between the upper portion 954*a* and the base. The deformation portion 954*d* buckles such that the upper portion 954*a* deforms in the Z2 direction.

Further, a lower portion 953*e* that projects in the Z2 direction is formed within the first rubber dome 951, and a movable contact 955 is provided on the surface on the Z2 side of the lower portion 953*e*. Similarly, a lower portion 954*e* that projects in the Z2 direction is formed within the second rubber dome 952, and a movable contact 956 is provided on the surface on the Z2 side of the lower portion 954*e*. In this example, the movable contact 955 and the movable contact 956 are formed of electrically conductive carbon or the like.

Figure 11A:
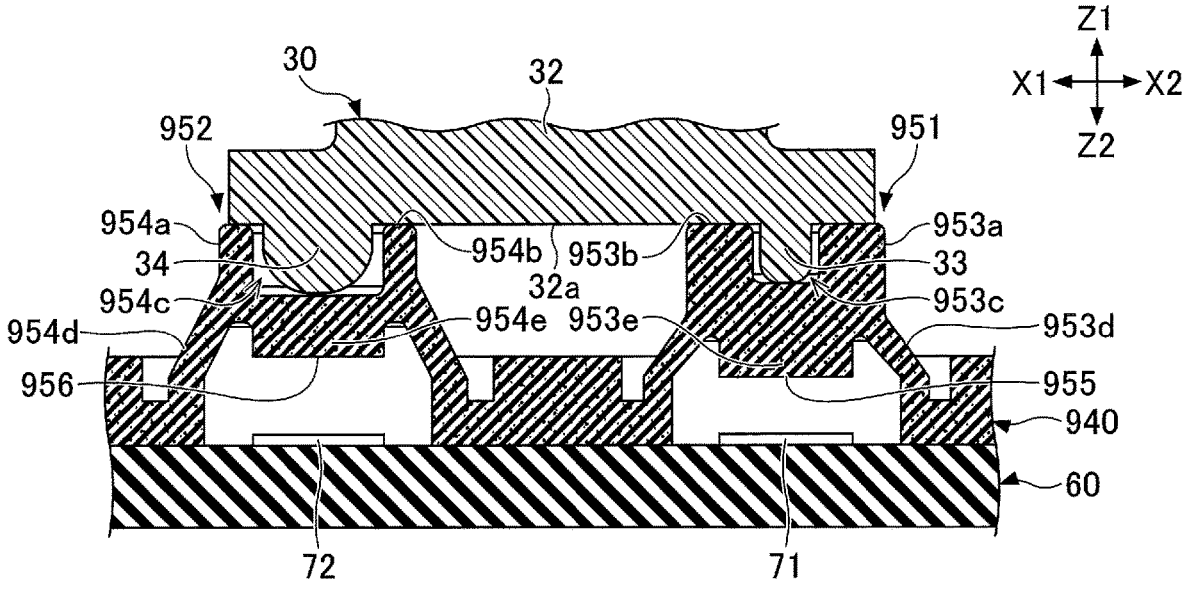
FIG.11A PRIOR ART
FIG. 11A is a diagram (1) illustrating deformation of rubber domes.
Figure 11B:
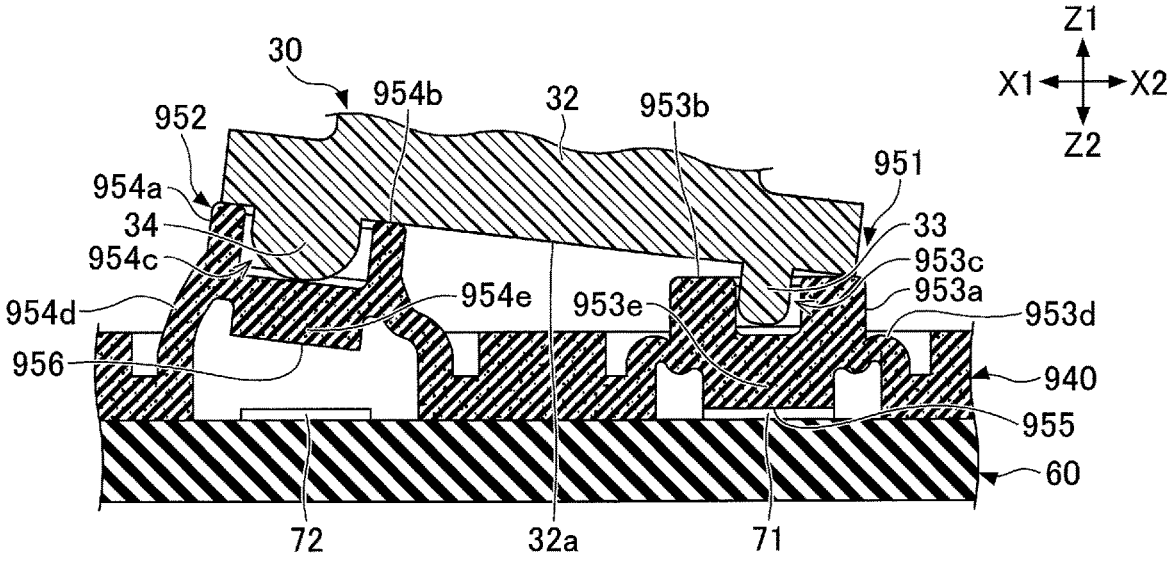
FIG.11B PRIOR ART
FIG. 11B is a diagram (2) illustrating deformation of the rubber domes.
Figure 11C:
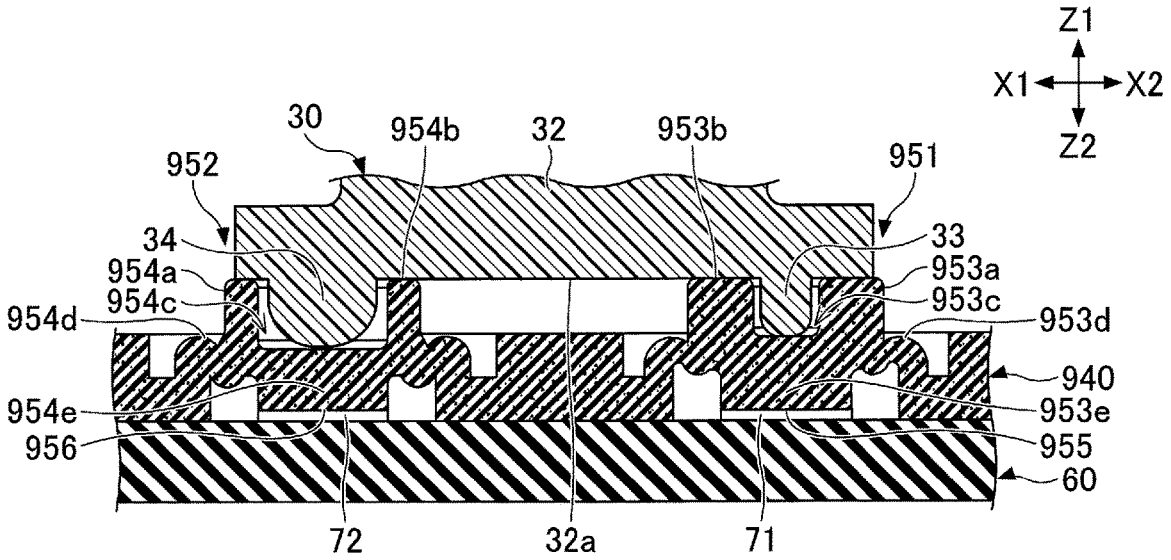
FIG.11C PRIOR ART
FIG. 11C is a diagram (3) illustrating deformation of the rubber domes.

FIG. 11A through FIG. 11C are diagrams illustrating states in which the rubber domes deform. The rubber dome sheet 940 is placed on the substrate 60 so as to cover the substrate 60, and an actuator 30 is placed on the rubber dome sheet 940.

FIG. 11A illustrates a state before the actuator 30 is pressed. A projection 33 formed on a pressing portion 32 of the actuator 30 is inserted into a recess 953*c* of the first rubber dome 951, and a projection 34 is inserted into a recess 954*c* of the second rubber dome 952. In this state, the bottom surface 32*a* of the pressing portion 32 of the actuator 30 is in contact with the upper surface 953*b* of the first rubber dome 951 and the upper surface 954*b* of the second rubber dome 952. In the state illustrated in FIG. 11A, the bottom surface 32*a* of the pressing portion 32 of the actuator 30 is approximately parallel to the XY-plane, and the upper surface 953*b* of the first rubber dome 951 and the upper surface 954*b* of the second rubber dome 952 are also approximately parallel to the XY-plane.

In this state, when the actuator 30 is pressed, the upper surface 953*b* of the first rubber dome 951, into which the projection 33 of the pressing portion 32 of the actuator 30 is inserted, is pressed, thereby causing the deformation portion 953*d* to buckle as illustrated in FIG. 11B. In the state illustrated in FIG. 11B, the movable contact 955 provided on the lower portion 953*e* of the first rubber dome 951 contacts the first fixed contact 71 provided on the substrate. As a result, a first switch is turned on. In this state, although the second rubber dome 952 is pressed by the pressing portion 32 of the actuator 30, the deformation portion 954*d* does not completely buckle because the pressing force of the pressing portion 32 of the actuator 30 is biased toward the first rubber dome 951. Accordingly, as illustrated in FIG. 11B, the bottom surface 32*a* of the pressing portion 32 of the actuator 30 is inclined with respect to the XY-plane. That is, the bottom surface 32*a* of the pressing portion 32 is inclined such that the X2 side of the bottom surface 32*a* is lower than the X1 side of the bottom surface 32*a* (in the Z2 direction). In this state, the force is applied to the second rubber dome 952 as described above. Therefore, the upper surface 954*b* of the second rubber dome 952 is inclined in accordance with the inclination of the bottom surface 32*a* of the pressing portion 32 of the actuator 30, and the deformation portion 954*d* of the second rubber dome 952 is partially deformed.

Then, when the actuator 30 is further pressed, the deformation portion 954*d* of the second rubber dome 952 buckles as illustrated in FIG. 11C, and the movable contact 956 provided on the lower portion 954*e* of the second rubber dome 952 contacts the second fixed contact 72 provided on the substrate. As a result, a second switch is turned on.

Figure 12:
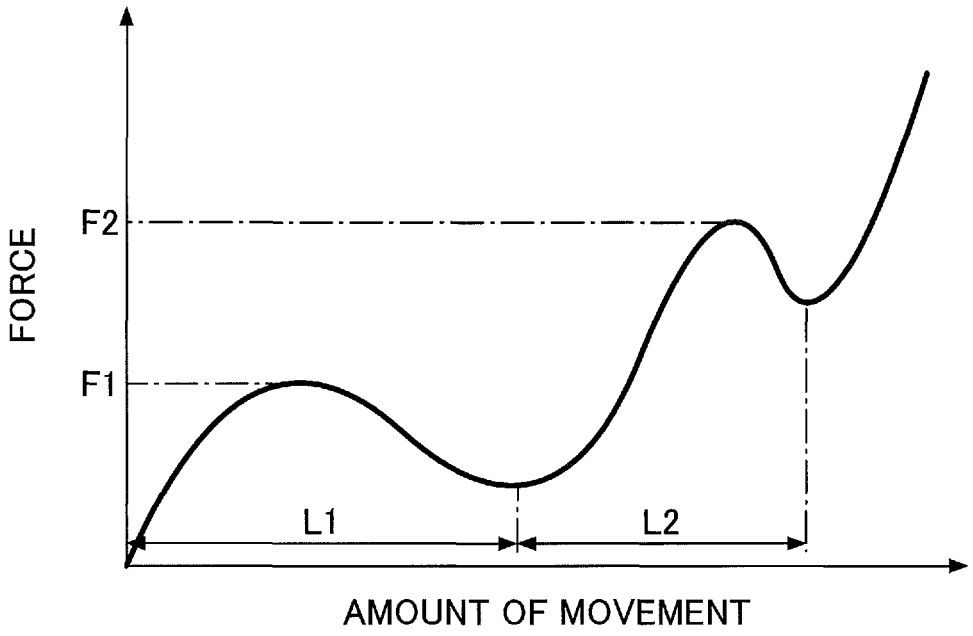
FIG.12 PRIOR ART
FIG. 12 is a graph illustrating characteristics of a two-stage switch using the rubber dome sheet of FIG. 8 through FIG. 11C.

FIG. 12 is a graph indicating the relationship between the amount of movement and force when an operation part is pressed in the two-stage switch using the above-described typical rubber dome sheet 940. In FIG. 12, the amount of movement L1 indicates the amount of displacement until the first switch is turned on after the operation part is pressed. The amount of movement L2 indicates the amount of displacement until the second switch is turned on after the first switch is turned on. In the two-stage switch, the amount of movement L1 is preferably approximately equal to the amount of movement L2 in terms of tactile feel during operation. For example, if the amount of movement L2 is too small, the second switch would be turned on by being slightly pressed after the first switch is turned on. This would make it difficult to keep only the first switch on. Further, if the amount of movement L2 is larger than the amount of movement L1, it would be difficult to perceive how much force is required to turn on the second switch after the first switch is turned on. That is, it would be difficult to intuitively turn the second switch on by pressing the operation part. Therefore, in terms of tactile feel for operation of the two-stage switch, it is preferable for the amount of movement L1 until the first switch is turned on after the operation part is pressed to be approximately equal to the amount of movement L2 until the second switch is turned on after the first switch is turned on.

However, as illustrated in FIG. 12, in the two-stage switch using the rubber sheet dome illustrated in FIG. 8 to FIG. 11C, the amount of movement L2 is smaller than the amount of movement L1. This is because, although the deformation portion 954*d* of the second rubber dome 952 does not completely buckle, the deformation portion 954*d* is pressed by the bottom surface 32*a* of the pressing portion 32 of the actuator 30, and the upper surface 954*b* of the second rubber dome 952 is inclined as illustrated in FIG. 11B. In the state illustrated in FIG. 11B, the upper surface 954*b* of the second rubber dome 952 is inclined, and a part of the deformation portion 954*d* of the second rubber dome 952, that is, the X1 side of the deformation portion 954*d* of the second rubber dome 952 deforms.

Further, as illustrated in FIG. 11B, if the part of the deformation portion 954*d* of the second rubber dome 952 deforms, a large load would be applied to the part of the deformation portion 954*d* of the second rubber dome 952, and this part would be readily damaged, thus reducing the life of the second rubber dome 952.

In view of the above, it may be contemplated that in order to enhance the strength of the deformation portion 954*d* of the second rubber dome 952, the thickness of the entire deformation portion 954*d* of the second rubber dome 952 should be increased. This would prevent the deformation of the part of the deformation portion 954*d* of the second rubber dome 952, when the deformation portion 953*d* of the first rubber dome 951 is pressed until buckles by the bottom surface 32*a* of the pressing portion 32 of the actuator 30. It would be also possible to prevent the inclination of the upper surface 954*b* of the second rubber dome 952. Thus, the amount of movement L1 would become approximately equal to the amount of movement L2, and further, the life of the rubber dome would be extended. However, with this approach, because the strength of the deformation portion 954*d* of the second rubber dome 952 is increased, the force required to buckle the deformation portion 954*d* of the second rubber dome 952 would also be increased. Thus, a considerable amount of force would be required to turn the second switch on, thus resulting in poor tactile feel.

In terms of tactile feel for two-stage switch operation, it is preferable for the relationship F1:F2 to be approximately 1:2, where F1 denotes force F1 required to turn the first switch on, and F2 denotes force F2 required to turn the second switch on.

Accordingly, it is desirable to provide a two-stage switch in which the amount of movement L1 until the first switch is turned can be approximately equal to the amount of movement L2 until the second switch is turned on after the first switch is turned on, without requiring much force to turn the second switch on.

(Rubber Domes According to the Present Embodiment)

Figure 13:
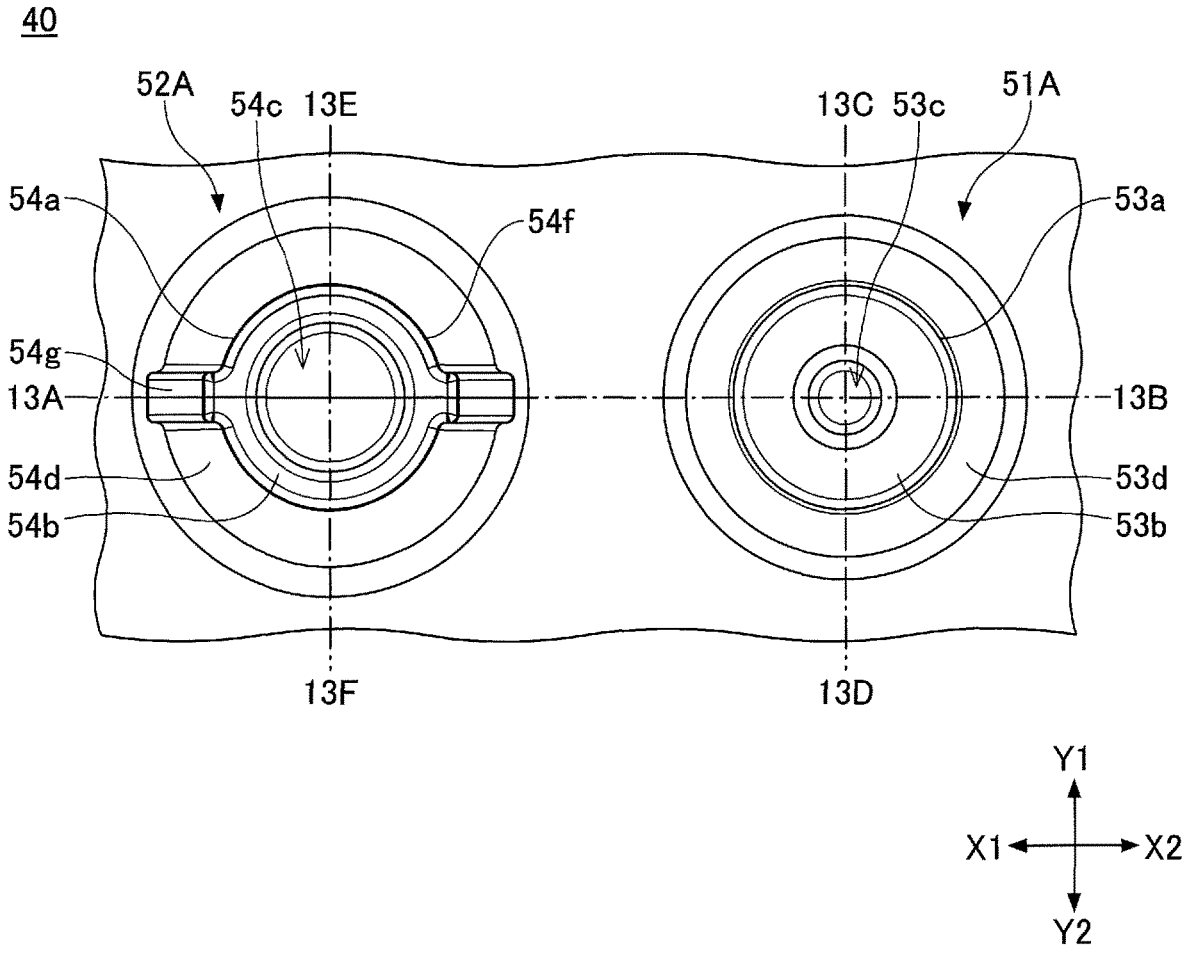
FIG. 13 is a top view of the rubber dome sheet according to the embodiment.
Figure 14:
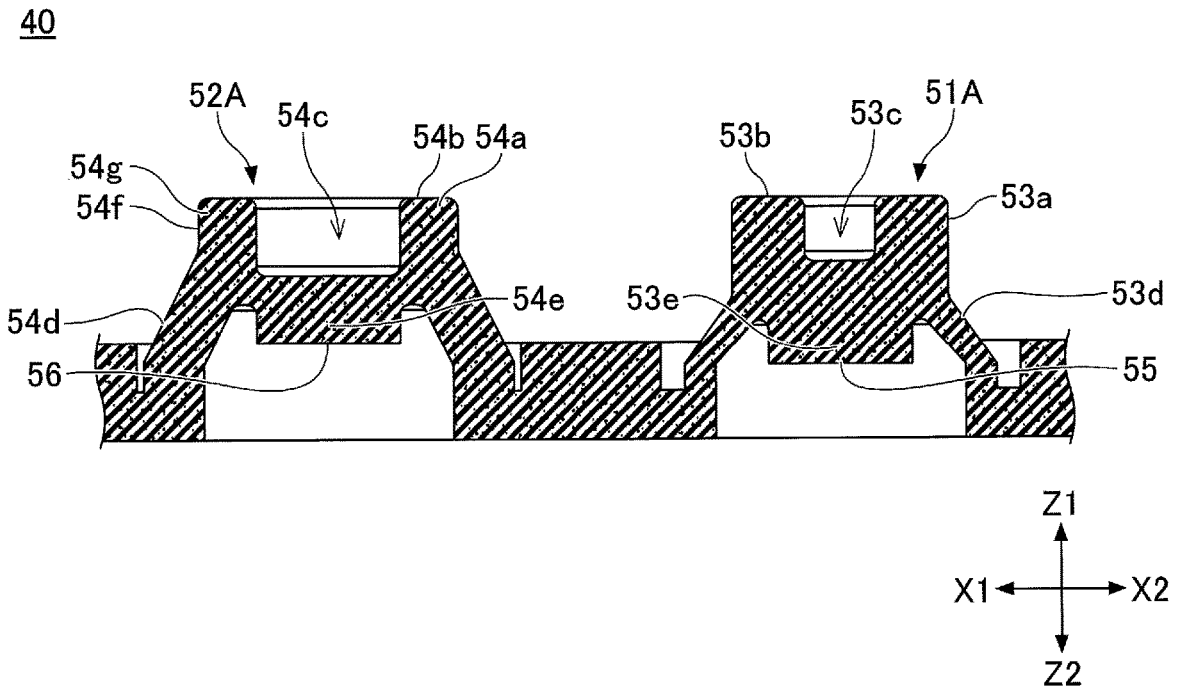
FIG. 14 is a cross-sectional view (1) of the rubber dome sheet according to the embodiment.
Figure 15A:
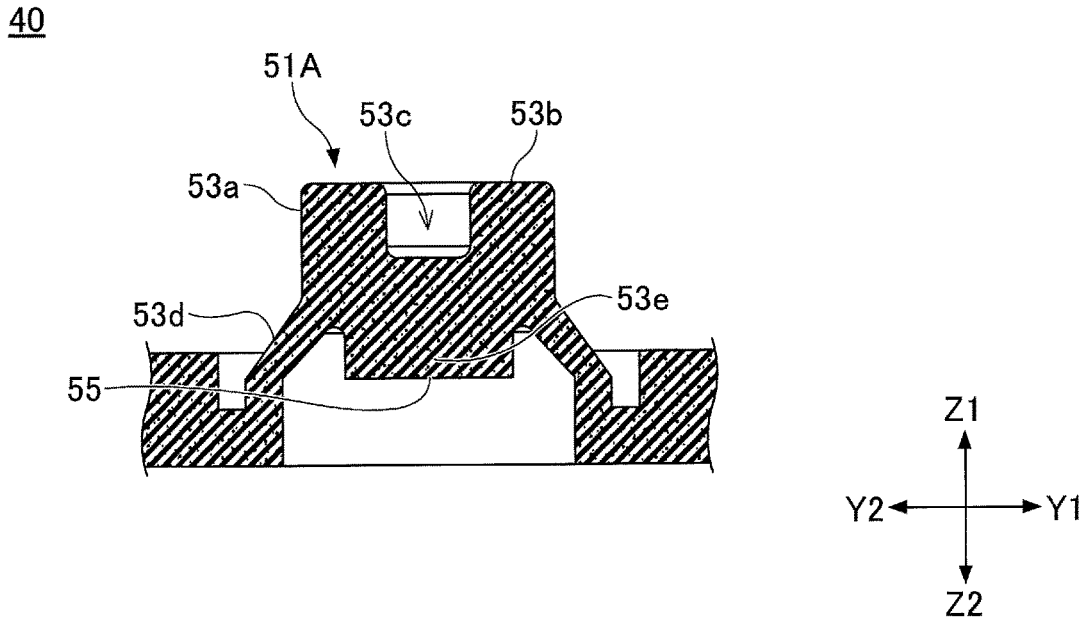
FIG. 15A is a cross-sectional view (2) of the rubber dome sheet according to the embodiment.
Figure 15B:
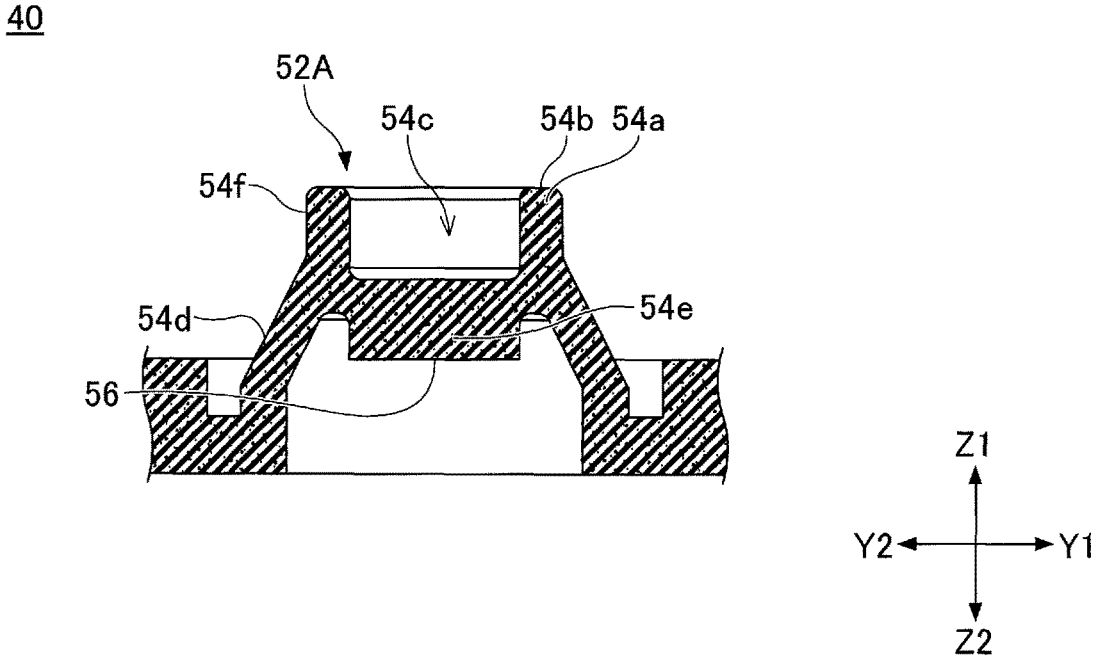
FIG. 15B is a cross-sectional view (3) of the rubber dome sheet according to the embodiment.

Next, the rubber domes according to the present embodiment will be described with reference to FIG. 13 through FIG. 15B. FIG. 13 is a top view of the rubber dome sheet 40 of the switch device according to the present embodiment. FIG. 14 is a cross-sectional view of the rubber dome sheet 40 taken through dash-dot line 13A-13B of FIG. 13. FIG. 15A is a cross-sectional view of the rubber dome sheet 40 taken through dash-dot line 13C-13D of FIG. 13. FIG. 15B is a cross-sectional view of the rubber dome sheet 40 taken through dash-dot line 13E-13F of FIG. 13. In the following, a two-stage switch configured by the first rubber dome 51A and the second rubber dome 52A will be described; however, a two-stage switch will be configured by the first rubber dome 51B and the second rubber dome 52B in a similar manner.

In the present embodiment, in the rubber dome 52A, rib portions 54*g* (thick portions) are formed in the X1-X2 direction of the upper outer surface 54*f* of the upper portion 54*a* and the deformation portion 54*d*, such that the thickness in the X1-X2 direction of the upper outer surface 54*f* and of the deformation portion 54*d* is increased. Therefore, the thickness in the X1-X2 direction of the upper outer surface 54*f* and of the deformation portion 54*d* where the rib portions 54*g* are formed, is larger than the thickness in the Y1-Y2 direction of the upper outer surface 54*f* and of the deformation portion 54*d* where no rib portion 54*g* is formed. For example, in the second rubber dome 52A, while the thickness in the Y1-Y2 direction of the deformation portion 54*d* where no rib portion 54*g* is formed may be approximately 0.45 mm, the thickness in the X1-X2 direction of the deformation portion 54*d* where the rib portions 54*g* are formed may be approximately 0.55 mm.

Note that the X1-X2 direction is a direction in which the first rubber dome 51A and the second rubber dome 52A are aligned. Accordingly, in the second rubber dome 52A, the rib portions 54*g* are formed on each side of the upper portion 53*a* and of the deformation portion 54*d* in the X1-X2 direction. In other words, the rib portions 54*g* are formed on each side, in the direction in which the first rubber dome 51A and the second rubber dome 52A are aligned, of the upper portion 53*a* and of the deformation portion 54*d*.

Further, the first rubber dome 51A does not include rib portions. Therefore, in the first rubber dome 51A, the thickness in the X1-X2 direction of the upper portion 53*a* and the deformation portion 54*d* is approximately the same as the thickness in the Y1-Y2 direction of the upper portion 53*a* and the deformation portion 54*d*. For example, the thickness in the X1-X2 direction of the deformation portion 54*d* and the thickness in the Y1-Y2 direction of the deformation portion 53*d* may be the same, and may be approximately 0.35 mm.

Figure 16A:
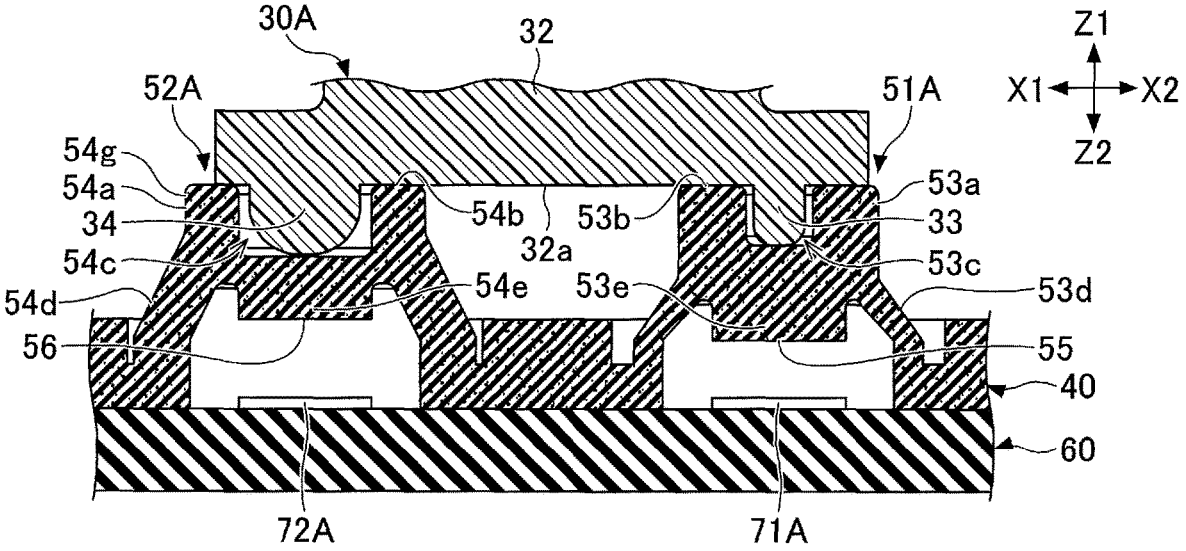
FIG. 16A is a diagram (1) illustrating the deformation of rubber domes according to the present embodiment.
Figure 16B:
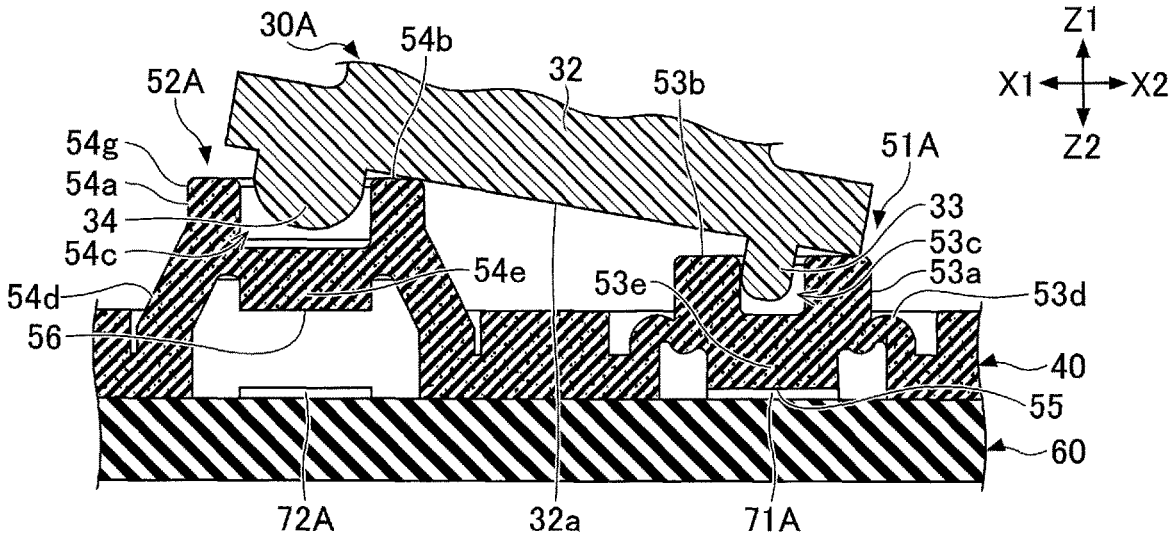
FIG. 16B is a diagram (2) illustrating the deformation of the rubber domes according to the present embodiment.
Figure 16C:
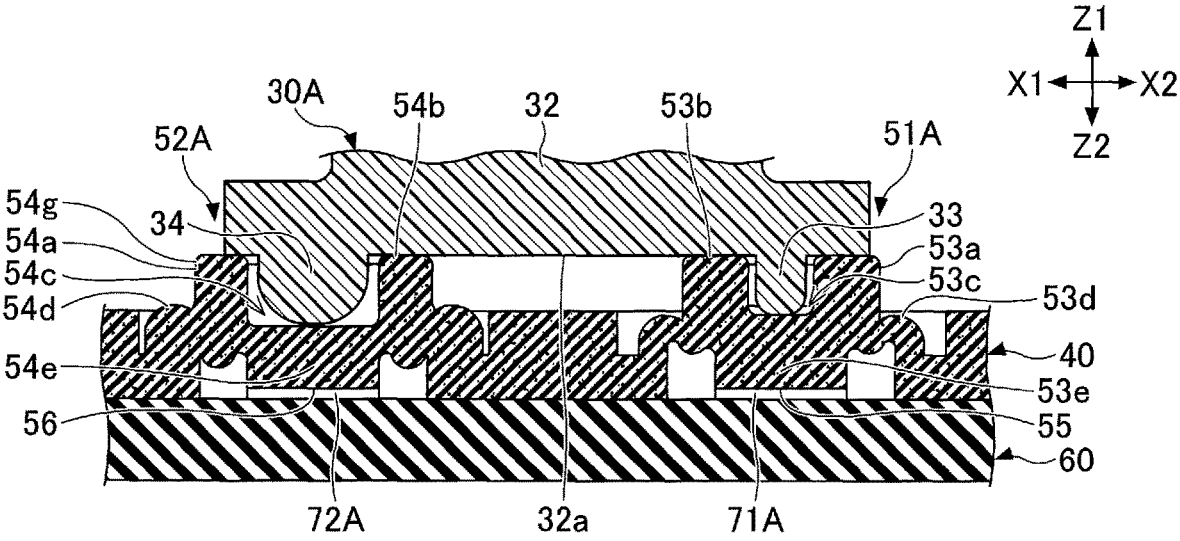
FIG. 16C is a diagram (3) illustrating the deformation of the rubber domes according to the present embodiment.

FIG. 16A through FIG. 16C are diagrams illustrating the deformation of the rubber domes when the rubber domes are pressed by the actuator 30A. The rubber dome sheet 40 is placed on the substrate 60, and the actuator 30A is placed on the rubber dome sheet 40.

FIG. 16A illustrates a state before the actuator 30A is pressed. The projection 33 formed on the pressing portion 32 of the actuator 30A is inserted into the recess 53*c* of the first rubber dome 51A, and the projection 34 is inserted into the recess 54*c* of the second rubber dome 52A. In this state, the bottom surface 32*a* of the pressing portion 32 of the actuator 30A contacts the upper surface 53*b* of the first rubber dome 51A and the upper surface 54*b* of the second rubber dome 52A. Accordingly, in the state illustrated in FIG. 16A, the bottom surface 32*a* of the pressing portion 32 of the actuator 30A is approximately parallel to the XY-plane, and also the upper surface 53*b* of the first rubber dome 51A and the upper surface 54*b* of the second rubber dome 52A are approximately parallel to the XY-plane.

In this state, when the actuator 30A is pressed by pressing the operation part 10, the upper surface 53*b* of the first rubber dome 51A, into which the projection 33 of the pressing portion 32 of the actuator 30A is inserted, is pressed, thereby causing the deformation portion 53*d* to buckle as illustrated in FIG. 16B. In the state illustrated in FIG. 16B, the movable contact 55 provided on the lower portion 53*e* of the first rubber dome 51A contacts the first fixed contact 71A provided on the substrate. As a result, the first switch is turned on. In the present embodiment, in the second rubber dome 52A, the rib portions 54*g* are formed on each side in the X1-X2 direction of the upper outer surface 54*f* and the deformation portion 54*d*. Therefore, the thickness of the upper outer surface 54*f* and the deformation portion 54*d* where the rib portions 54*g* are formed is increased, thereby resulting in an increase in strength. In this state, although the second rubber dome 52A is pressed by the pressing portion 32 of the actuator 30 and force is applied to the second rubber dome 52A, the shape of the second rubber dome 52A is maintained by the rib portions 54*g* formed on the upper outer surface 54*f* and the deformation portion 54*d*. Accordingly, the deformation of the upper surface 54*b* of the second rubber dome 52A can be prevented, and the upper surface 54*b* of the second rubber dome 52A is approximately parallel to the XY-plane.

In the state illustrated in FIG. 16B, the bottom surface 32*a* of the pressing portion 32 of the actuator 30A is inclined with respect to the XY-plane. That is, the bottom surface 32*a* of the pressing portion 32 is inclined such that the X2 side of the bottom surface 32*a* is lower than the X1 side of the bottom surface 32*a* (in the Z2 direction).

Then, when the actuator 30A is further pressed, the deformation portion 54*d* of the second rubber dome 52A buckles as illustrated in FIG. 16C, and the movable contact 56 provided on the lower portion 54*e* of the second rubber dome 52A contacts the second fixed contact 72A provided on the substrate 60. As a result, the second switch is turned on.

Figure 17:
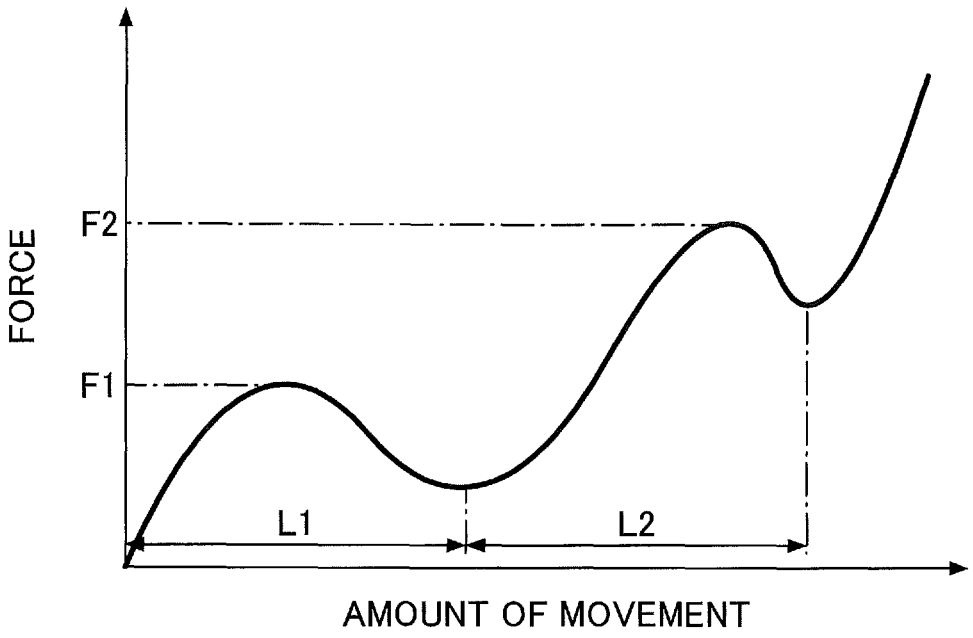
FIG. 17 is a graph illustrating characteristics of a two-stage switch using the rubber dome sheet according to the present embodiment.

FIG. 17 is a graph indicating the relationship between the amount of movement and force when the operation part is pressed in the two-stage switch using the rubber dome sheet 40 according to the present embodiment. In FIG. 17, the amount of movement L1 indicates the amount of displacement until the first switch is turned on after the operation part is pressed. The amount of movement L2 indicates the amount of displacement until the second switch is turned on after the first switch is turned on.

In the present embodiment, as illustrated in FIG. 16B, the rib portions 54*g* are formed on each side of the upper outer surface 54*f* and of the deformation portion 54*d* to which the force is applied, and thus, the strength on each side of the upper outer surface 54*f* and of the deformation portion 54*d* is increased. Accordingly, when the upper surface 54*b* of the second rubber dome 52A is pressed by the bottom surface 32*a* of the actuator 30A, the deformation portion 54*d* does not deform and the shape of the second rubber dome 52A can be maintained. Thus, the upper surface 54*b* of the second rubber dome 52A is not inclined.

Accordingly, as illustrated in FIG. 17, in the two-stage switch using the rubber dome sheet 40 according to the present embodiment, the amount of movement L1 can be approximately equal to the amount of movement L2. Further, in the state as illustrated in FIG. 16B, the deformation portion 54*d* of the second rubber dome 52A is not deformed. Accordingly, the life of the second rubber dome 52A can be extended.

Further, in the second rubber dome 52A, the thickness of the deformation portion 54*d* where no rib portion 54*g* is formed is smaller than the thickness of the deformation portion 54*d* where the rib portions 54*g* are formed. Therefore, the force required for the deformation portion 54*d* to buckle is less large, and the relationship F1:F2=1:2 can be established, where F1 denotes force 1 required to turn the first switch on, and F1 denotes force 2 required to turn the second switch on.

Accordingly, the switch device according to the present embodiment provides improved tactile feel for two-stage operation and has improved longevity.

(Variations)

Figure 18:
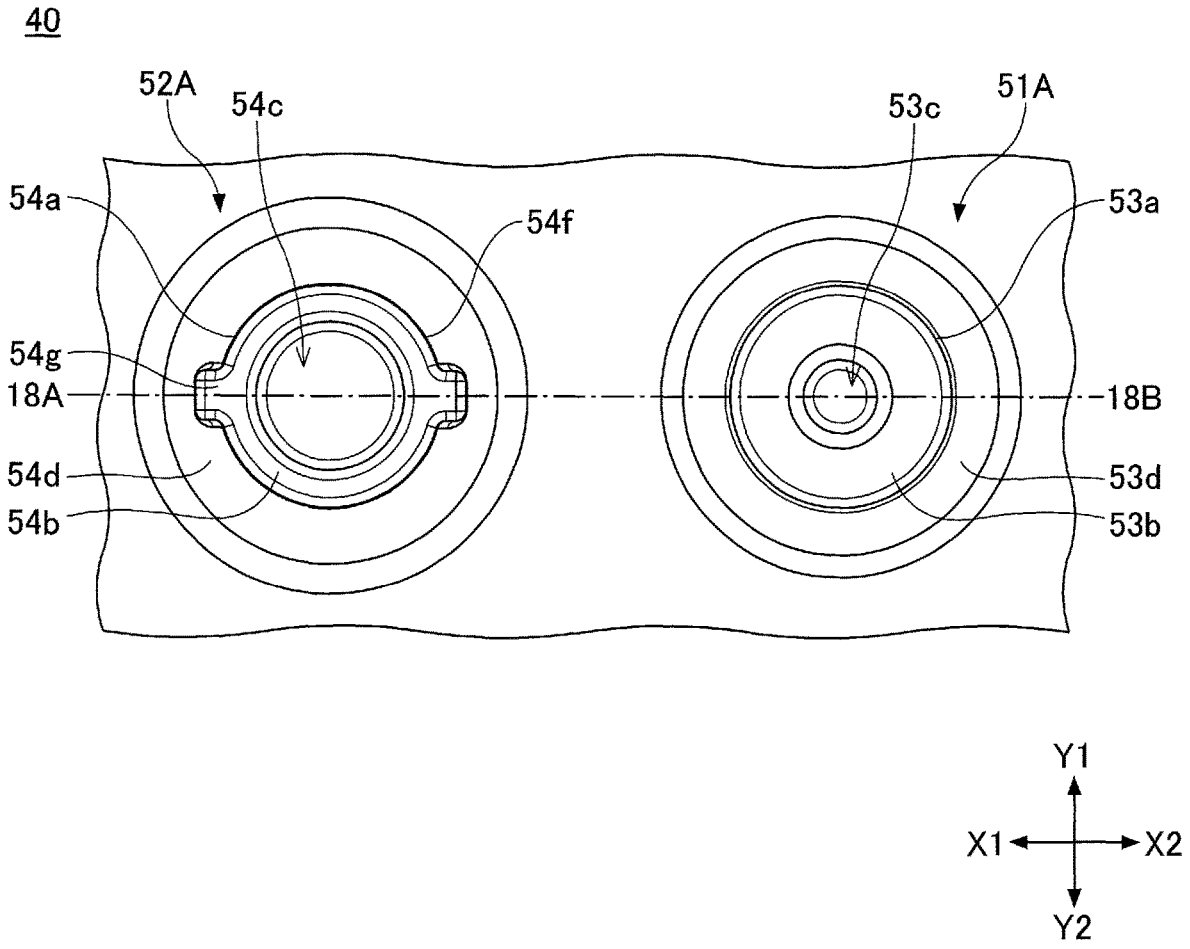
FIG. 18 is a top view of a rubber dome sheet according to a first variation.
Figure 19:
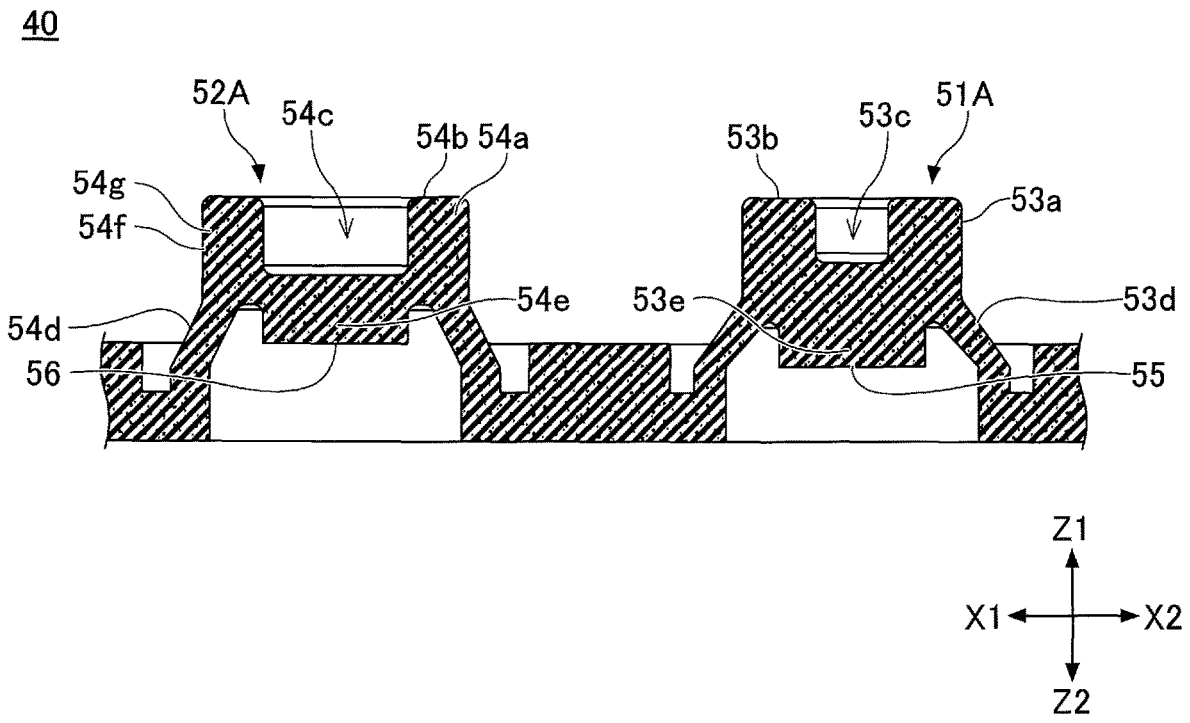
FIG. 19 is a cross-sectional view of the rubber dome sheet according to the first variation.

In a switch device according to a first variation, rib portions 54*g* may be formed on only the deformation portion 54*d* of the second rubber dome 52A, or may be formed on only the upper outer surface 54*f*. Specifically, as illustrated in FIG. 18 and FIG. 19, the switch device may include rib portions 54*g* formed on only the upper outer surface 54*f*. FIG. 18 is a top view of a rubber dome sheet according to the first variation. FIG. 19 is a cross-sectional view of the rubber dome sheet taken through dash-dot line 18A-18B of FIG. 18.

Figure 20:
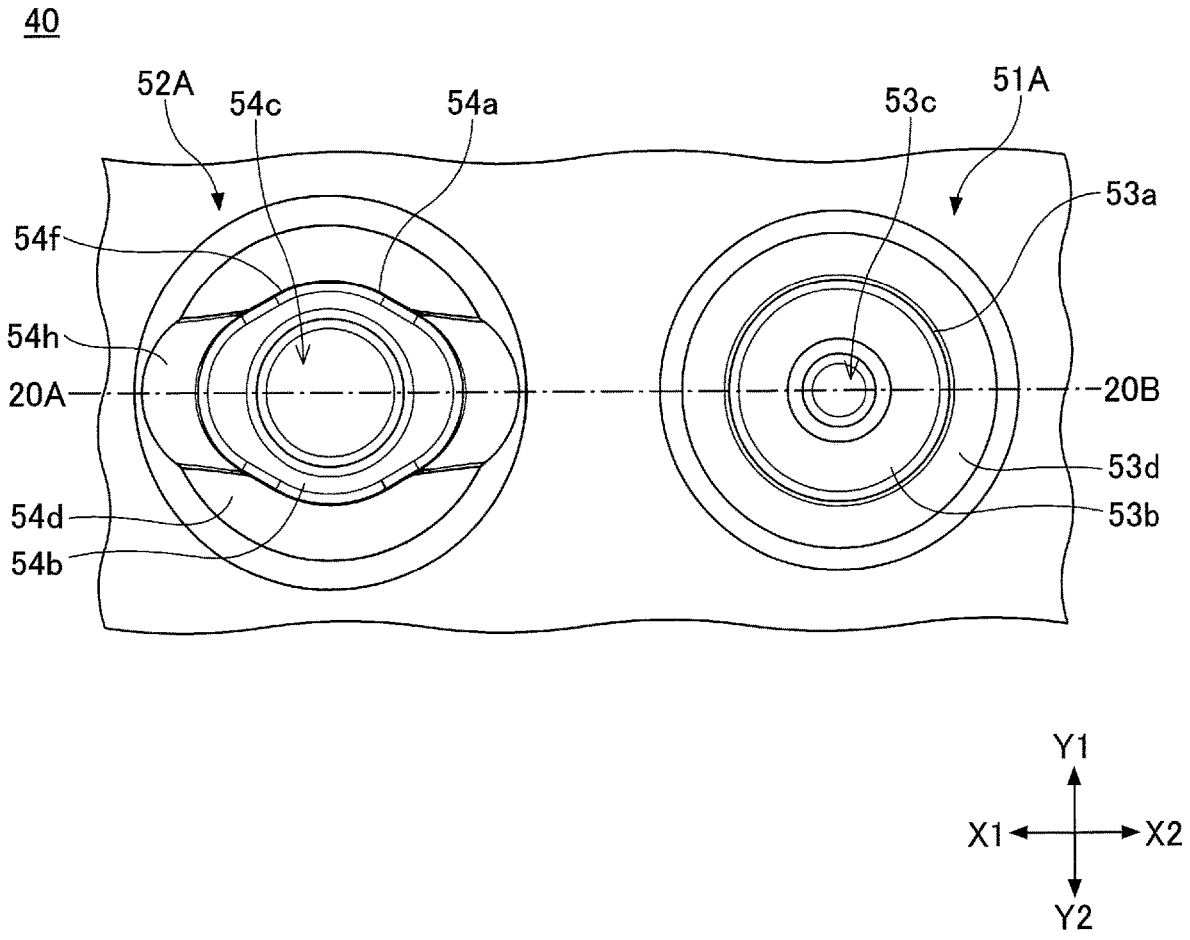
FIG. 20 is a top view of a rubber dome sheet according to a second variation.
Figure 21:
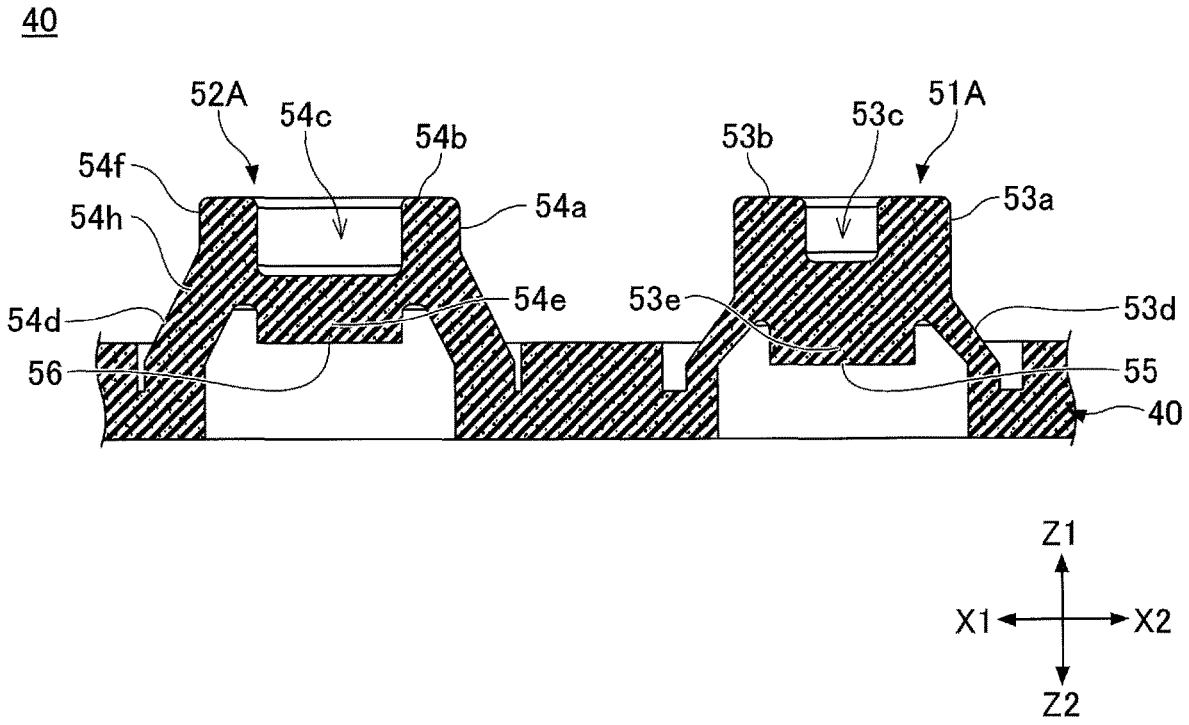
FIG. 21 is a cross-sectional view (1) of the rubber dome sheet according to the second variation.
Figure 22:
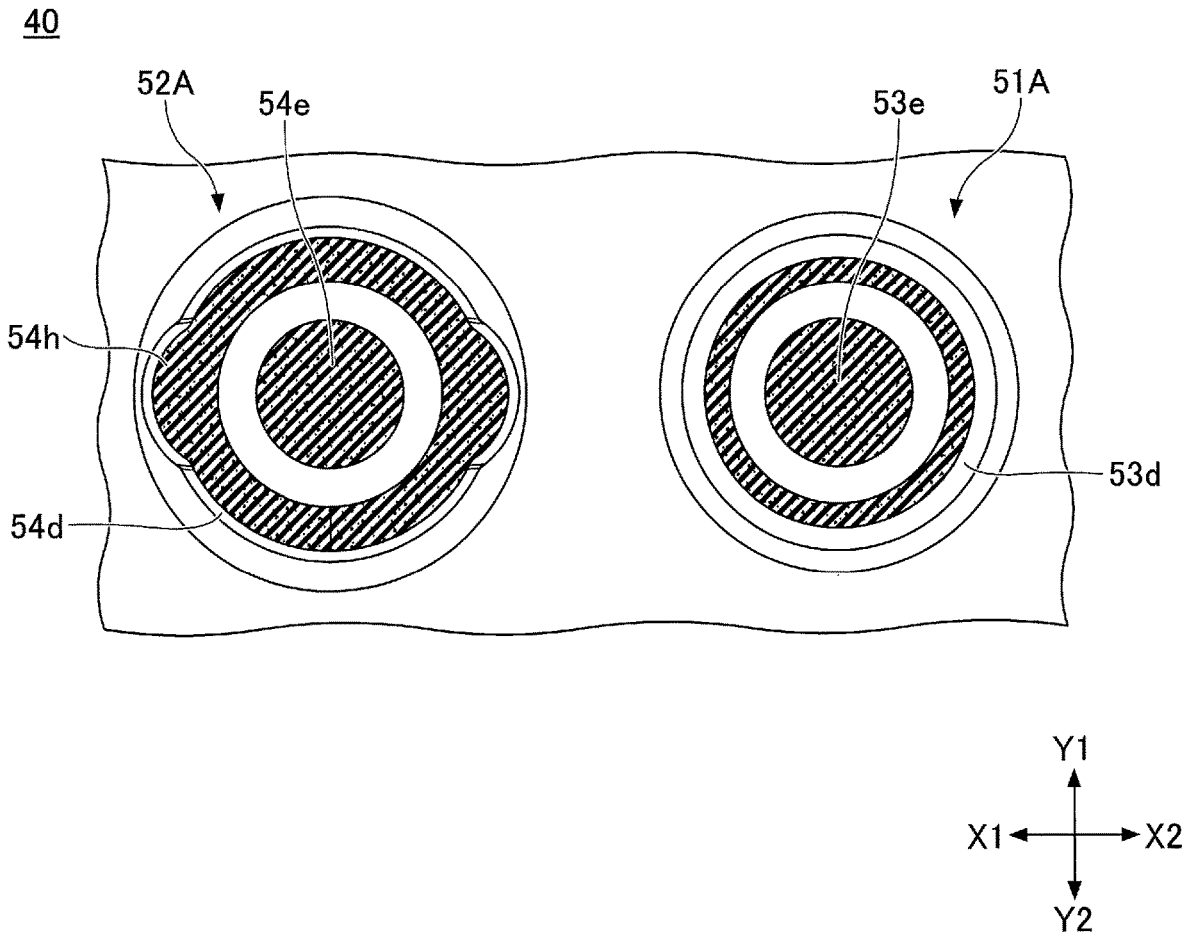
FIG. 22 is a cross-sectional view (2) of the rubber dome sheet according to the second variation.

Further, a switch device according to a second variation may include thick portions each having a shape other than a rib shape and whose thickness is increased. Specifically, as illustrated in FIG. 20 through FIG. 22, thick portions 54*h* may be formed on each side of the upper outer surface 54*f* and of the deformation portion 54*d* of the second rubber dome 52A in the X1-X2 direction. The thick portions 54*h* each extend in the X1-X2 direction, and no thick portion 54*h* is formed on either side of the upper outer surface 54*f* in the Y1-Y2 direction and the deformation portion 54*d*. FIG. 20 is a top view of a rubber dome sheet according to the second variation. FIG. 21 is a cross-sectional view of the rubber dome sheet taken through dash-dot line 20A-20B of FIG. 20. FIG. 22 is a cross-sectional view of the rubber dome sheet taken along a plane parallel to the XY-plane.

Even when the above-described thick portions 54*h* are formed on each side of the upper outer surface 54*f* and of the deformation portion 54*d* of the second rubber dome 52A, an effect similar to that of the rib portion 54*g* can be obtained.

Figure 23:
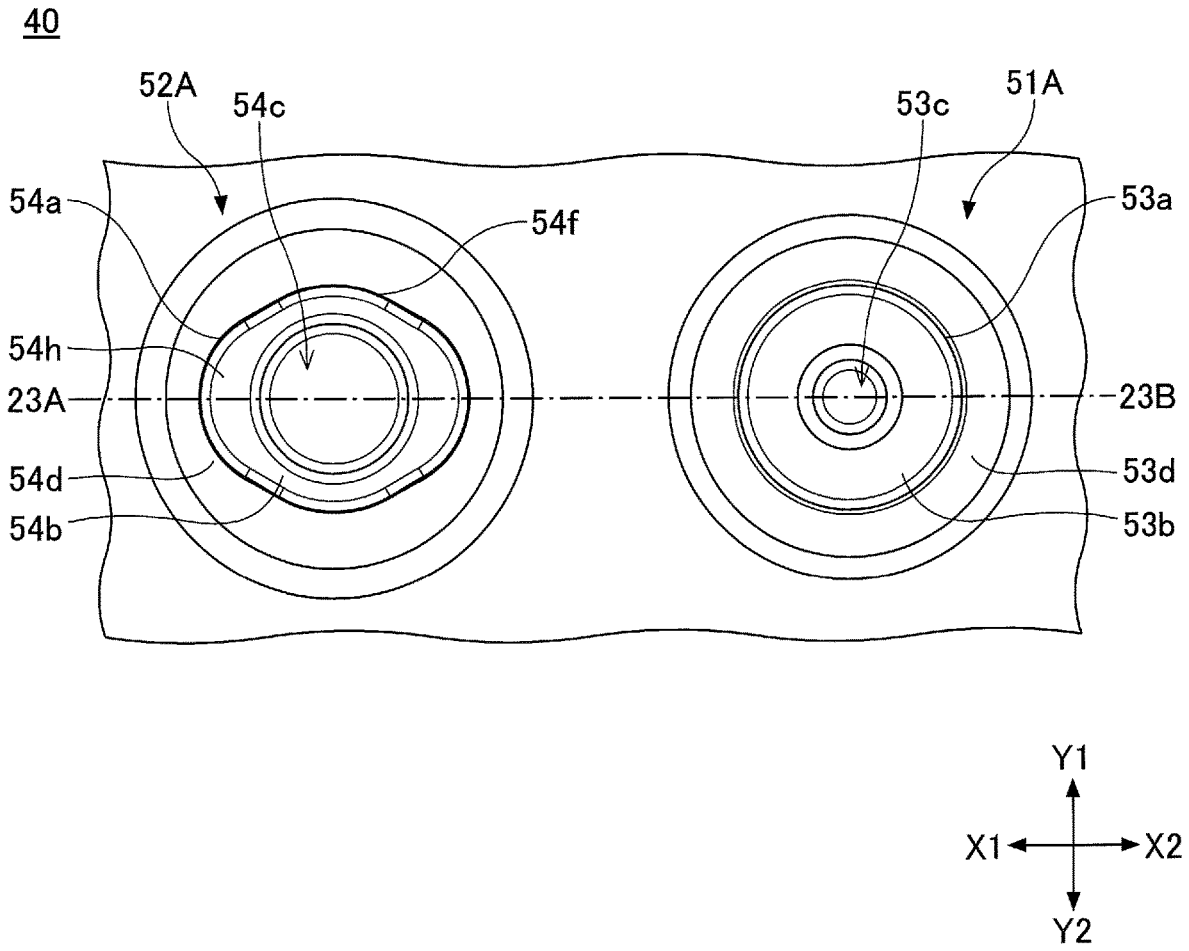
FIG. 23 is a top view of a rubber dome sheet according to a third variation.
Figure 24:
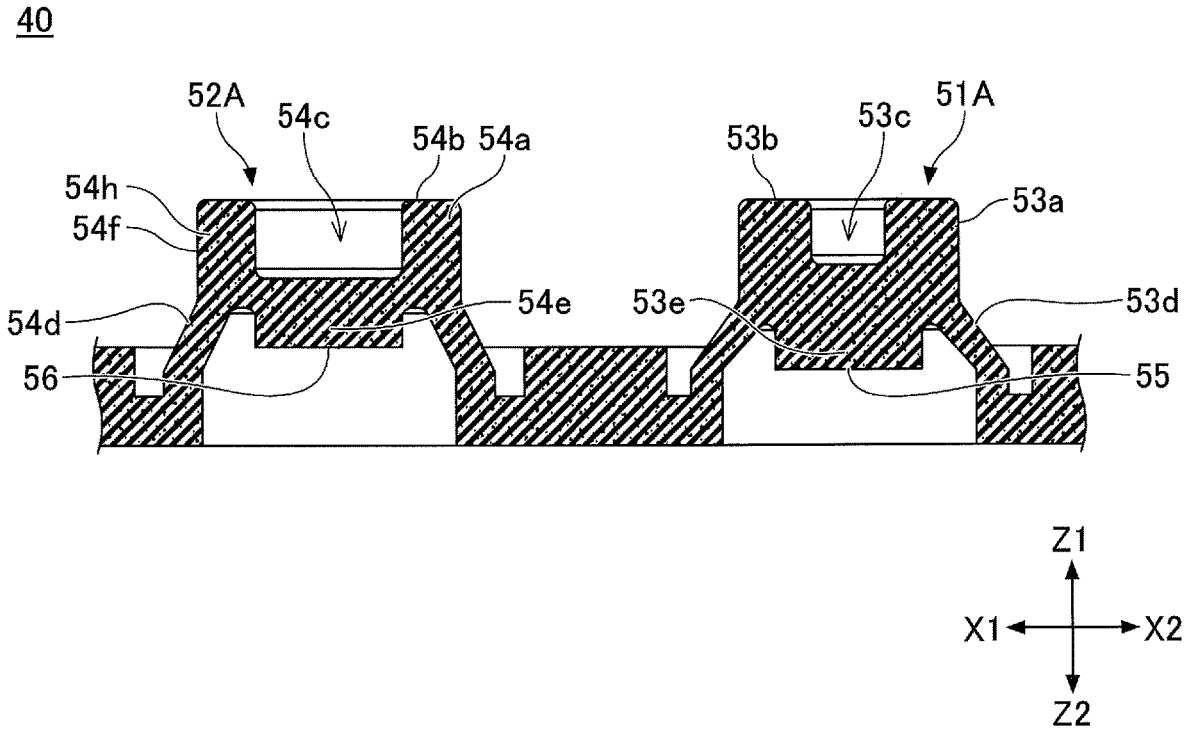
FIG. 24 is a cross-sectional view of the rubber dome sheet according to the third variation.

Further, in a switch device according a third variation, thick portions 54*h* may be formed on only the deformation portion 54*d* of the second rubber dome 52A, or may be formed on only the upper outer surface 54*f*. For example, as illustrated in FIG. 23 and FIG. 24, the switch device may include thick portions 54*h* formed only on the upper outer surface 54*f*. FIG. 23 is a top view of a rubber dome sheet according to the third variation. FIG. 24 is a cross-sectional view of the rubber dome sheet taken through dash-dot line 23A-23B of FIG. 23.

As used herein, the term "rib portion" may be referred to as a thick portion.

Although the specific embodiments have been described above, the present invention is not limited to the particulars of the described embodiments, and modifications and variations may be made without departing from the scope of the present invention.

What is claimed is:

1. A switch device comprising:

a rubber dome sheet including:

a base;

a first rubber dome protruding from the base and forming a first upper portion having a first upper surface; and a second rubber dome protruding from the base and forming a second upper portion having a second upper surface; and a slider disposed on the first upper surface of the first rubber dome and the second upper surface of the second rubber dome, wherein the slider presses the first upper surface of the first rubber dome, causing deformation of the first rubber dome in a case where the slider is moved toward the first rubber dome and the second rubber dome, and the slider presses the second upper surface of the second rubber dome, causing deformation of the second rubber dome in a case where the slider is further moved toward the first rubber dome and the second rubber dome in a state in which the first rubber dome is subjected to the deformation, and a thick portion is formed at a side wall of the second rubber dome between the second upper portion and the base and positioned along an imaginary line between a center of the first rubber dome and a center of the second rubber dome, said thick portion having a thickness that is greater than that of other portions of the side wall that are not positioned along the imaginary line.

2. The switch device according to claim 1, wherein the first rubber dome includes a first deformation portion and the second rubber dome includes a second deformation portion at the side wall, the first deformation portion and the second deformation portion buckle upon being pressed by the slider, and the thick portion is formed on the second deformation portion of the side wall of the second rubber dome.

3. The switch device according to claim 1, further comprising, a first movable contact formed within the first rubber dome, a second movable contact formed within the second rubber dome, a substrate, and a first fixed contact and a second fixed contact provided on a surface of the substrate, wherein the first movable contact formed within the first rubber dome faces the first fixed contact, and the second movable contact formed within the second rubber dome faces the second fixed contact, the first movable contact formed within the first rubber contacts the first fixed contact when the first rubber dome deforms, and the second movable contact formed within the second rubber dome contacts the second fixed contact when the second rubber dome deforms.

4. The switch device according to claim 1, further comprising an operation part, wherein the operation of the operation part moves the slider and causes the slider to press the first upper surface of the first rubber dome, and the operation of the operation part further moves the slider and causes the slider to press the second upper surface of the second rubber dome.

5. The switch device according to claim 3, wherein the first movable contact has a thickness in a moving direction of the first movable contact greater than that of the second movable contact.

6. The switch device according to claim 1, wherein the side wall inclines relative to the second upper portion and the base.

* * * * *